US010081190B2

(12) United States Patent
Nakano

(10) Patent No.: US 10,081,190 B2
(45) Date of Patent: Sep. 25, 2018

(54) METHOD FOR MAINTENANCE OF LIQUID DISCHARGE HEAD AND LIQUID DISCHARGE APPARATUS

(71) Applicant: FUJIFILM Corporation, Tokyo (JP)

(72) Inventor: Takuma Nakano, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/609,545

(22) Filed: May 31, 2017

(65) Prior Publication Data

US 2017/0259575 A1 Sep. 14, 2017

Related U.S. Application Data

(63) Continuation of application No. PCT/JP2015/082726, filed on Nov. 20, 2015.

(30) Foreign Application Priority Data

Dec. 1, 2014 (JP) ..... 2014-243011

(51) Int. Cl.
*B41J 2/165* (2006.01)

(52) U.S. Cl.
CPC ..... *B41J 2/16535* (2013.01); *B41J 2/16552* (2013.01)

(58) Field of Classification Search
None
See application file for complete search history.

(56) References Cited

U.S. PATENT DOCUMENTS 6,036,299 A 3/2000 Kobayashi et al.
2008/0218554 A1 9/2008 Inoue
(Continued)

FOREIGN PATENT DOCUMENTS

JP 50-45152 U 5/1975
JP 11-157102 A 6/1999
(Continued)

OTHER PUBLICATIONS

Ip.com search.*
(Continued)

*Primary Examiner* — Lisa M Solomon
(74) *Attorney, Agent, or Firm* — Birch, Stewart, Kolasch & Birch, LLP

(57) ABSTRACT

The method includes: a wiping processing step of performing wiping processing on a liquid discharge surface by eccentrically rotating a wiping surface of a wiping member, including raised irregularities on the wiping surface thereof, in a plane parallel to the liquid discharge surface of a liquid discharge head and moving the wiping member in a first direction in a state in which the wiping surface is in contact with the liquid discharge surface; and a post-wiping processing purge processing step of performing post-wiping processing purge processing after the wiping processing step. An eccentric parameter as a value obtained by dividing an eccentric distance of the wiping surface by an interval between the nozzles in a second direction orthogonal to the first direction, is set to 10 or more in the wiping processing step.

11 Claims, 21 Drawing Sheets

(56) References Cited

U.S. PATENT DOCUMENTS

| | | | | |
|---|---|---|---|---|
| 2009/0051732 | A1* | 2/2009 | Kato | B41J 2/16538 347/33 |
| 2011/0193914 | A1 | 8/2011 | Yamada et al. | |
| 2012/0050394 | A1 | 3/2012 | Takada et al. | |
| 2012/0050403 | A1 | 3/2012 | Inoue | |
| 2013/0076830 | A1 | 3/2013 | Inoue | |
| 2013/0250000 | A1 | 9/2013 | Yamamoto | |

FOREIGN PATENT DOCUMENTS

| | | | |
|---|---|---|---|
| JP | 2008-221534 | A | 9/2008 |
| JP | 2011-161827 | A | 8/2011 |
| JP | 2012-51184 | A | 3/2012 |
| JP | 2012-71573 | A | 4/2012 |
| JP | 2013-71360 | A | 4/2013 |
| JP | 2013-199081 | A | 10/2013 |

OTHER PUBLICATIONS

Japanese Office Action, dated Feb. 16, 2018, for Japanese Application No. 2014-243011, with an English machine translation.
International Search Report (PCT/ISA/210) issued in PCT/JP2015/082726, dated Dec. 22, 2015.
Written Opinion of the International Searching Authority (PCT/ISA/237) issued in PCT/JP2015/082726, dated Dec. 22, 2015.
Japanese Office Action dated Apr. 24, 2018 for corresponding Japanese Application No. 2014-243011, with English translation.

* cited by examiner

METHOD FOR MAINTENANCE OF LIQUID DISCHARGE HEAD AND LIQUID DISCHARGE APPARATUS

CROSS-REFERENCE TO RELATED APPLICATIONS

The present application is a Continuation of PCT International Application No. PCT/JP2015/082726 filed on Nov. 20, 2015 claiming priority under 35 U.S.C. § 119(a) to Japanese Patent Application No. 2014-243011 filed on Dec. 1, 2014. Each of the above applications is hereby expressly incorporated by reference, in their entirety, into the present application.

BACKGROUND OF THE INVENTION

1. Field of the Invention

The present invention relates to a method for maintenance of a liquid discharge head and a liquid discharge apparatus, and more particularly, to a technique for maintenance of a liquid discharge head.

2. Description of the Related Art

When an ink jet liquid discharge head discharges liquid from nozzles, liquid adheres to the peripheries of the nozzles and the inside of the nozzles. When liquid adheres to the peripheries of the nozzles and the inside of the nozzles, a cause of the deterioration of discharge performance, such as the occurrence of flying bending of liquid, occurs.

The maintenance of a liquid discharge head is regularly performed in a liquid discharge apparatus, which includes the liquid discharge head, to suppress the deterioration of discharge performance. Examples of the maintenance of the liquid discharge head include wiping processing for a liquid discharge surface and purge processing.

JP2012-51184A and JP2013-71360A disclose wiping devices that wipe the liquid discharge surface of a liquid discharge head. Each of the wiping devices disclosed in JP2012-51184A and JP2013-71360A removes liquid and the like adhering to the liquid discharge surface by making a rotating wiping member be in contact with the liquid discharge surface and wiping the liquid discharge surface.

Terms of "the liquid discharge head", "the liquid discharge surface", and "the wiping member" correspond to terms of "an ink jet head", "a nozzle surface", and "a wiping pad" of JP2012-51184A and JP2013-71360A, respectively.

JP2013-199081A discloses a liquid discharge apparatus that wipes a liquid discharge surface by using a wiping member of which the surface has been subjected to raising. The liquid discharge apparatus disclosed in JP2013-199081A wipes the inside of nozzles by allowing raised yarn portions of the wiping member to be thrust into the nozzles when wiping a liquid discharge surface by using a wiping member.

Terms of "the wiping member", "the liquid discharge surface", and "the liquid discharge apparatus" correspond to terms of "a wiping web", "a nozzle surface", and "a liquid droplet discharge apparatus" of JP2013-199081A, respectively.

SUMMARY OF THE INVENTION

Various countermeasures in the related art have been taken as a method of suppressing the deterioration of the discharge performance of the liquid discharge head that is caused by materials adhering to the liquid discharge surface or adhering materials that are present in the nozzles. However, an effect of recovering the discharge performance of the liquid discharge head has been insufficient.

The wiping device disclosed in JP2012-51184A and the wiping device disclosed in JP2013-71360A can remove the materials adhering to the peripheries of the nozzles and materials adhering to the liquid discharge surface, but it is difficult for the wiping devices to remove the adhering materials that are present in the nozzles. For this reason, the recovery of the discharge performance of the liquid discharge head is insufficient.

The liquid discharge apparatus disclosed in JP2013-199081A removes adhering materials, which are present in the nozzles, by making the raised yarn, which is formed on the surface of the wiping member, be thrust into the nozzles. However, when the raised yarn is made to be thrust into the nozzles and wipes the inside of the nozzles, bubbles are trapped in the nozzles. For this reason, the number of abnormal nozzles in which a flight direction is significantly bent is increased. As a result, the recovery of the discharge performance of the liquid discharge head is insufficient.

The invention has been made in consideration of the above-mentioned circumstances, and an object of the invention is to provide a method for maintenance of a liquid discharge head and a liquid discharge apparatus that stably and reliably recover the discharge performance of a liquid discharge head of which the discharge performance has deteriorated.

In order to achieve the object, a first aspect provides a method for maintenance of a liquid discharge head. The method comprises: a wiping processing step of performing wiping processing on a liquid discharge surface by eccentrically rotating a wiping surface of a wiping member, which includes raised irregularities on the wiping surface thereof, in a plane parallel to the liquid discharge surface of a liquid discharge head and moving the wiping member in a first direction in a state in which the wiping surface is in contact with the liquid discharge surface; and a post-wiping processing purge processing step of performing post-wiping processing purge processing for discharging liquid, which is present in the liquid discharge head, from a plurality of nozzles provided on the liquid discharge surface by adjusting internal pressure of the liquid discharge head to a pressure, which is equal to or higher than the atmospheric pressure, after the wiping processing step. An eccentric parameter as a value obtained by dividing an eccentric distance, which is represented by a distance between a center of noneccentric rotation and a center of eccentric rotation of the wiping surface, by an interval between the nozzles in a second direction orthogonal to the first direction, is set to 10 or more, the wiping member is eccentrically rotated, and a pressing force, which allows the irregularities of the wiping surface to be thrust into the nozzles, is applied to the wiping member to make the wiping surface come into contact with the liquid discharge surface, so that the wiping processing is performed on the liquid discharge surface in the wiping processing step.

According to the first aspect, the nozzles can be wiped in multiple directions since the wiping surface is eccentrically rotated. Further, since the wiping surface including raised irregularities is used, adhering materials present in the nozzles can be removed by the raised irregularities thrust into the nozzles. Since the purge processing is performed after the wiping processing, bubbles present in the nozzles can be discharged. Accordingly, it is possible to lengthen the life of the liquid discharge head by recovering the discharge performance of the liquid discharge head of which the discharge state has deteriorated due to the deterioration of discharge performance.

The direction of eccentricity may be a direction that is parallel to the second direction, and may be a direction that is not parallel to the second direction. Examples of the direction, which is not parallel to the second direction, include the first direction orthogonal to the second direction.

According to a second aspect, the method according to the first aspect further comprises a wiping-internal-pressure setting step of setting a set value of the internal pressure of the liquid discharge head of the wiping processing step to a value equal to or larger than a set value of the internal pressure of the liquid discharge head that is set at the time of liquid discharge performed on the basis of input discharge data.

According to the second aspect, the trapping of bubbles in the nozzles at the time of the wiping processing, which uses the wiping member including the raised irregularities on the wiping surface thereof, is suppressed.

According to a third aspect, the method according to the first or second aspect further comprises a purge period setting step of setting a purge period of the post-wiping processing purge processing step to a period three or more times as long as a standard purge period that is a processing period of a standard purge processing step.

According to the third aspect, bubbles trapped in the nozzles can be discharged by the post-wiping processing purge processing even though bubbles are trapped in the nozzles when wiping processing using the wiping member, which includes the raised irregularities on the wiping surface thereof, is performed.

According to a fourth aspect, in the method according to the third aspect, in the purge period setting step, the purge period of the post-wiping processing purge processing step is set to a period five or less times as long as the standard purge period.

According to the fourth aspect, the consumption of liquid is suppressed while the discharge of bubbles, which are present in the nozzles, performed by the post-wiping processing purge processing is maintained.

According to a fifth aspect, in the method according to the third or fourth aspect, in the purge period setting step, a processing period of purge processing in a case in which the purge processing is performed alone or a processing period of purge processing at the time of initialization processing is set to the standard purge period.

In the fifth aspect, from the viewpoint of conditions, such as the structure of the liquid discharge head, the type of liquid to be used, and the environment of the apparatus, and the suppression of the consumption of liquid in the purge processing, the standard purge period is determined as a period in which certain effective effects are obtained.

According to a sixth aspect, in the method according to any one of the first to fifth aspects, in the wiping processing step, the eccentric parameter is set to 20 or more and the wiping member is eccentrically rotated.

According to the sixth aspect, the recovery state of the discharge performance of the liquid discharge head can be made to be a higher recovery state.

According to a seventh aspect, in the method according to any one of the first to fifth aspects, in the wiping processing step, the eccentric parameter is set to 33 or more and the wiping member is eccentrically rotated.

According to the seventh aspect, a variation in the recovery state of the discharge performance of the liquid discharge head is suppressed. Accordingly, the recovery state of the discharge performance of the liquid discharge head can be stably made to be a high recovery state.

According to an eighth aspect, in the method according to any one of the first to seventh aspects, in the wiping processing step, the eccentric parameter is set to be equal to or smaller than a value where the eccentric distance is obtained as a value smaller than a half of the maximum length of the wiping surface, and the wiping member is eccentrically rotated.

According to the eighth aspect, the upper limit of the eccentric parameter can be determined from the size of the wiping member.

According to a ninth aspect, in the method according to any one of the first to eighth aspects, in the wiping processing step, the center of eccentric rotation of the wiping surface is moved on a straight line along the first direction on the liquid discharge surface.

According to the ninth aspect, the liquid discharge surface can be wiped in multiple directions while the wiping surface is moved in one direction.

According to a tenth aspect, in the method according to any one of the first to eighth aspects, a wiping surface, which has the maximum length corresponding to the entire length of the liquid discharge surface in the second direction, is used in the wiping processing step, and the center of eccentric rotation of the wiping surface is moved along a straight line that bisects the entire length of the liquid discharge surface in the second direction and is parallel to the first direction of the liquid discharge surface.

According to the tenth aspect, when the wiping member is eccentrically rotated one time, the wiping member can be made to come into contact with the liquid discharge surface over the entire length of the liquid discharge surface in the second direction. Accordingly, the entire liquid discharge surface can be wiped even though the wiping member is moved relative to the liquid discharge surface only one time.

The liquid discharge surface includes at least nozzle forming area in which the nozzles are formed. The liquid discharge surface may include a support member that supports the nozzle forming area.

According to an eleventh aspect, in the method according to any one of the first to tenth aspects, the wiping member is made to reciprocate in the first direction in the wiping processing step.

According to the eleventh aspect, since the number of times of contact between the liquid discharge surface and the wiping surface of the wiping member is increased, a wiping effect of removing adhering materials can be improved.

According to a twelfth aspect, in the method according to any one of the first to eleventh aspects, a liquid discharge head having a structure in which a longitudinal direction is the first direction, a lateral direction is the second direction, and the plurality of nozzles are arranged two-dimensionally on the liquid discharge surface is wiped in the wiping processing step.

Examples of the liquid discharge head having a structure in which a longitudinal direction is the first direction and a lateral direction is the second direction include a full-line type liquid discharge head where a direction in which the liquid discharge head and a medium are transported relative to each other is the second direction, a direction orthogonal to the direction in which the liquid discharge head and the medium are transported is the first direction, and nozzles are provided over a length corresponding to the entire length of the medium in the first direction.

A thirteenth aspect provides a liquid discharge apparatus comprising: a liquid discharge head; a wiping processing unit that performs wiping processing on a liquid discharge surface of the liquid discharge head; a wiping control unit that controls an operation of the wiping processing unit; a purge processing unit that performs post-wiping processing purge processing for discharging liquid, which is present in the liquid discharge head, from a plurality of nozzles provided on the liquid discharge surface after the wiping processing performed by the wiping processing unit; and a purge control unit that adjusts internal pressure of the liquid discharge head to a pressure equal to or higher than the atmospheric pressure. The wiping processing unit includes a wiping member that includes raised irregularities on a wiping surface thereof to be in contact with the liquid discharge surface, and has a structure for setting an eccentric parameter as a value obtained by dividing an eccentric distance, which is represented by a distance between a center of noneccentric rotation and a center of eccentric rotation of the wiping surface, by an interval between the nozzles in a second direction, which is orthogonal to a first direction, to 10 or more and eccentrically rotating the wiping member. The wiping control unit makes the wiping surface come into contact with the liquid discharge surface by applying a pressing force, which allows the irregularities of the wiping surface to be thrust into the nozzles, to the wiping member, eccentrically rotates the wiping surface in a plane parallel to the liquid discharge surface of the liquid discharge head, and moves the wiping member in the first direction in a state in which the wiping surface is in contact with the liquid discharge surface.

In the thirteenth aspect, it is preferable that the liquid discharge apparatus further includes a wiping-internal-pressure setting section for setting a set value of the internal pressure of the liquid discharge head of the wiping processing unit to a value equal to or larger than a set value of the internal pressure of the liquid discharge head that is set at the time of liquid discharge performed on the basis of input discharge data.

Examples of a wiping condition setting section, which sets the condition of the wiping processing performed by the wiping processing unit, can include a wiping-internal-pressure setting section.

In the thirteenth aspect, it is preferable that the liquid discharge apparatus further includes a purge period setting section for setting a purge period of the post-wiping processing purge processing to a period three or more times as long as a standard purge period that is a processing period of standard purge processing.

In the thirteenth aspect, it is preferable that the purge period setting section sets a purge period of the post-wiping processing purge processing to a period five or less times as long as the standard purge period.

In the thirteenth aspect, it is preferable that the purge period setting section sets a processing period of purge processing, which is obtained in a case in which the purge processing is performed alone, or a processing period of purge processing, which is obtained at the time of initialization processing, to the standard purge period.

Examples of a purge condition setting section, which sets the condition of the purge processing performed by the purge processing unit, can include a purge period setting section.

In the thirteenth aspect, it is preferable that the wiping processing unit sets the eccentric parameter to 20 or more and eccentrically rotates the wiping member.

In the thirteenth aspect, it is preferable that the wiping processing unit sets the eccentric parameter to 33 or more and eccentrically rotates the wiping member.

In the thirteenth aspect, it is preferable that the wiping processing unit sets the eccentric parameter to a value equal to or smaller than a value where the eccentric distance is obtained as a value smaller than a half of the maximum length of the wiping surface, and eccentrically rotates the wiping member.

In the thirteenth aspect, it is preferable that the wiping processing unit moves the center of eccentric rotation of the wiping surface on a straight line along the first direction on the liquid discharge surface.

In the thirteenth aspect, it is preferable that the wiping member includes a wiping surface, which has the maximum length corresponding to the entire length of the liquid discharge surface in the second direction, and the wiping control unit operates the wiping processing unit to move the center of eccentric rotation of the wiping surface along a straight line that bisects the entire length of the liquid discharge surface in the second direction and is parallel to the first direction of the liquid discharge surface.

In the thirteenth aspect, it is preferable that the wiping control unit operates the wiping processing unit to make the wiping member reciprocate in the first direction.

In the thirteenth aspect, it is preferable that the liquid discharge head has a structure in which a longitudinal direction is the first direction, a lateral direction is the second direction, and the plurality of nozzles are arranged two-dimensionally on the liquid discharge surface.

According to the invention, the nozzles can be wiped in multiple directions since the wiping surface is eccentrically rotated. Further, since the wiping surface including raised irregularities is used, adhering materials present in the nozzles can be removed by the raised irregularities thrust into the nozzles. Since the purge processing is performed after the wiping processing, bubbles present in the nozzles can be discharged. Accordingly, it is possible to lengthen the life of the liquid discharge head by recovering the discharge performance of the liquid discharge head of which the discharge state has deteriorated due to the deterioration of discharge performance.

DESCRIPTION OF THE PREFERRED EMBODIMENTS

A preferred embodiment of the invention will be described in detail below with reference to accompanying drawings.

[Structure of Main Portion of Liquid Discharge Apparatus]

Figure 1:
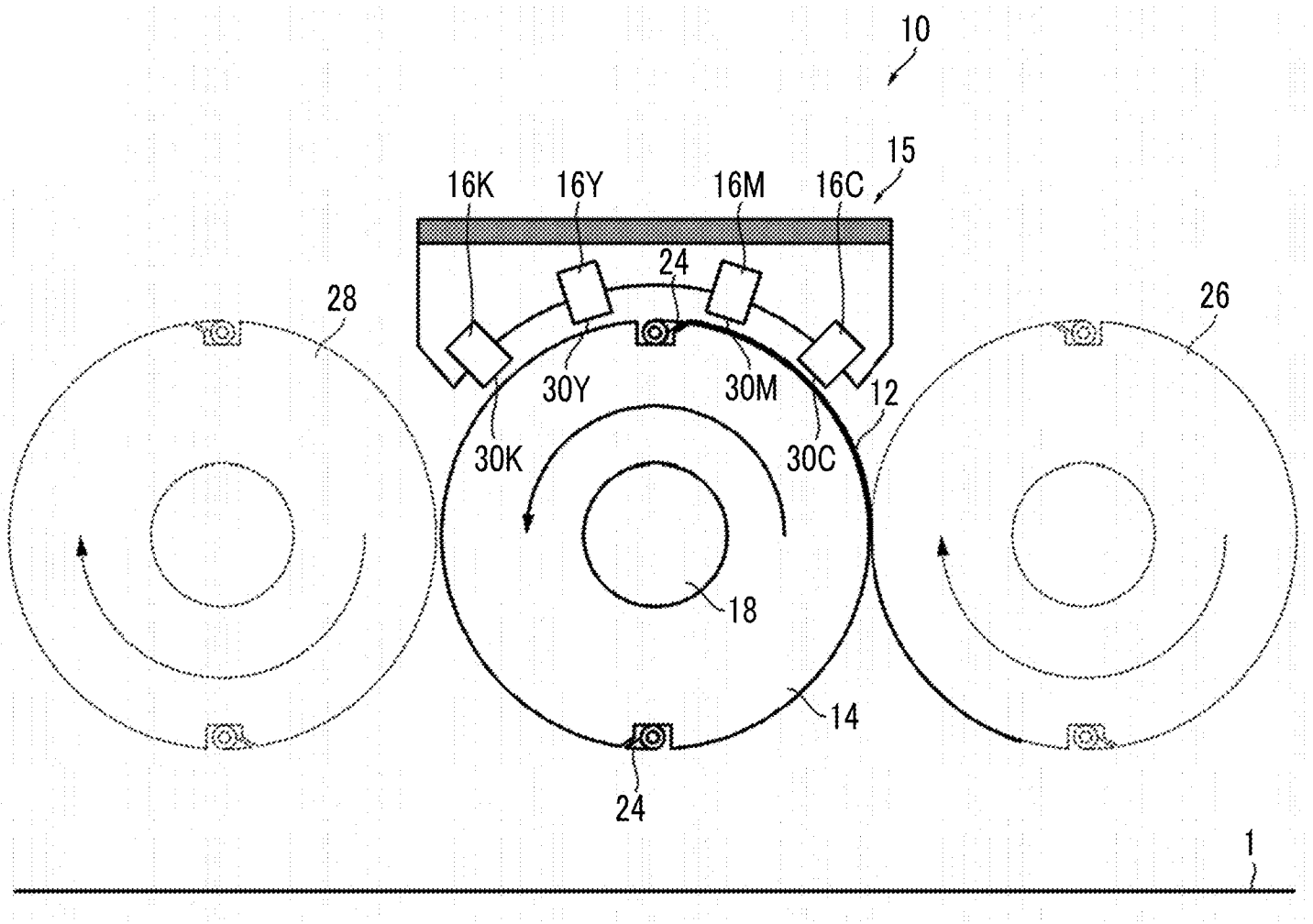
FIG. 1 is a view showing the structure of a main portion of a liquid discharge apparatus according to an embodiment of the invention.

FIG. 1 is a view showing the structure of a main portion of a liquid discharge apparatus according to an embodiment of the invention. The liquid discharge apparatus 10 shown in FIG. 1 is an ink jet recording apparatus that forms an image on a recording medium 12 with color ink.

Examples of the liquid discharge apparatus 10 include a liquid discharge apparatus that forms a pattern on a recording medium with liquid by an ink jet liquid discharge head. Substrates, which are made of metal, glass, a resin, and the like, can be applied as the recording medium. Liquid containing metal particles, liquid containing resin particles, and the like can be applied as the liquid.

The liquid discharge apparatus 10 transports the recording medium 12 while holding the recording medium 12 on a drawing cylinder 14. Then, cyan ink is discharged to the recording medium 12 from a liquid discharge head 16C, magenta ink is discharged to the recording medium 12 from a liquid discharge head 16M, yellow ink is discharged to the recording medium 12 from a liquid discharge head 16Y, and black ink is discharged to the recording medium 12 from a liquid discharge head 16K.

A color image, which uses cyan ink, magenta ink, yellow ink, and black ink, is formed on the image forming surface of the recording medium 12.

In this specification, alphabets C, M, Y, and K attached to reference numerals of the liquid discharge heads mean the liquid discharge heads corresponding to colors of cyan, magenta, yellow, and black.

The liquid discharge heads 16C, 16M, 16Y, and 16K are called ink jet liquid discharge heads or ink jet heads.

Both end portions of a rotating shaft 18 of the drawing cylinder 14 are pivotally supported by a pair of bearings so that the drawing cylinder 14 is rotatable. The bearings are not shown. The pair of bearings is provided in a body frame (not shown), both end portions of the rotating shaft 18 are pivotally supported by the pair of bearings, and the drawing cylinder 14 is mounted in parallel to a horizontal plane 1.

The term of "parallel" of this specification includes "substantially parallel" in which two directions cross each other but the same effects as the effects of a case in which the two directions are parallel to each other can be obtained. Further, the term of "orthogonal" of this specification includes "substantially orthogonal" in which two directions cross each other at an angle smaller than 90° or cross each other at an angle exceeding 90° but the same effects as the effects of a case in which the two directions cross each other at an angle of 90° can be obtained.

A motor is connected to the rotating shaft 18 of the drawing cylinder 14 through a rotation transmission mechanism (not shown). The drawing cylinder 14 is driven and rotated by the motor.

Grippers 24, each of which grips a front end portion of the recording medium 12, are provided on the peripheral surface of the drawing cylinder 14. The grippers 24 are installed at two positions on the outer peripheral surface of the drawing cylinder 14 of this embodiment.

The recording medium 12 is held on the outer peripheral surface of the drawing cylinder 14 while the front end portion of the recording medium 12 is gripped by the gripper 24. The drawing cylinder 14 is provided with a suction-holding mechanism (not shown). Examples of the suction-holding mechanism include electrostatic attraction mechanism, vacuum suction mechanism, and the like.

The recording medium 12, which is held on the outer peripheral surface of the drawing cylinder 14 by suction while the front end portion of the recording medium 12 is gripped by the gripper 24, is held on the outer peripheral surface of the drawing cylinder 14 while the back of the recording medium 12 is sucked by the suction-holding mechanism.

The four liquid discharge heads 16C, 16M, 16Y, and 16K are line heads corresponding to the width of the recording medium 12, and are radially arranged at regular intervals on the concentric circle that has a center on the rotating shaft 18 of the drawing cylinder 14. In an aspect shown in FIG. 1, the liquid discharge heads 16C, 16M, 16Y, and 16K are integrally supported by a head support part 15.

In this embodiment, the four liquid discharge heads 16C, 16M, 16Y, and 16K are arranged so as to be symmetrical with respect to the drawing cylinder 14. In the aspect shown in FIG. 1, the liquid discharge head 16C corresponding to cyan and the liquid discharge head 16K corresponding to black are arranged so as to be symmetrical with respect to a vertical direction, which passes through the center of the drawing cylinder 14 and is orthogonal to the horizontal plane 1, and the liquid discharge head 16M corresponding to magenta and the liquid discharge head 16Y corresponding to yellow are arranged so as to be symmetrical with respect to the vertical direction.

The respective liquid discharge heads 16C, 16M, 16Y, and 16K, which are arranged in this way, are arranged so that liquid discharge surfaces 30C, 30M, 30Y, and 30K of the respective liquid discharge heads face the outer peripheral surface of the drawing cylinder 14 and are inclined with respect to the horizontal plane 1.

Further, the liquid discharge heads 16C, 16M, 16Y, and 16K are arranged at positions where distances between the outer peripheral surface of the drawing cylinder 14 and the respective liquid discharge surfaces 30C, 30M, 30Y, and 30K are equal to each other.

In other words, gaps having the same size are formed between the outer peripheral surface of the drawing cylinder 14 and the respective liquid discharge surfaces 30C, 30M, 30Y, and 30K of the liquid discharge heads 16C, 16M, 16Y, and 16K.

In the liquid discharge apparatus 10, the recording medium 12 is fed to the drawing cylinder 14 through a delivery cylinder 26 provided in the front stage. Since the delivery cylinder 26 is disposed so that a delivery position of the recording medium 12 on the delivery cylinder 26 corresponds to a delivery position of the recording medium 12 on the drawing cylinder 14, the delivery cylinder 26 delivers the recording medium 12 to the drawing cylinder 14 without missing the timing. The delivery cylinder 26 shown in FIG. 1 forms a sheet feeding section denoted in FIG. 2 by reference numeral 114.

The recording medium 12 on which an image has been formed is delivered to a delivery cylinder 28, which is provided in the subsequent stage, from the drawing cylinder 14. Since the delivery cylinder 28 is disposed so that a delivery position of the recording medium 12 on the delivery cylinder 28 corresponds to a delivery position of the recording medium 12 on the drawing cylinder 14, the delivery cylinder 28 receives the recording medium 12 from the drawing cylinder 14 without missing the timing.

The subsequent stage of the delivery cylinder 28 is not shown in this embodiment. However, the subsequent stage of the delivery cylinder 28 is provided in a sheet discharge section denoted in FIG. 2 by reference numeral 121. A post-processing section, which performs post-processing on the recording medium 12 on which an image has been formed, may be further provided. Examples of the post-processing section include a drying processing section, a fixing section, a coating processing section, and the like.

A preprocessing section, which performs preprocessing on a recording medium on which an image is not yet formed, may be further provided in the front stage of the delivery cylinder 26. Examples of the preprocessing section include a drying processing section, a fixing section, a coating processing section, and the like.

In this embodiment, a transport method using the drawing cylinder 14 has been exemplified but other transport methods, such as a transport method using a transport belt, may be applied.

[Configuration of Control System]

Figure 2:
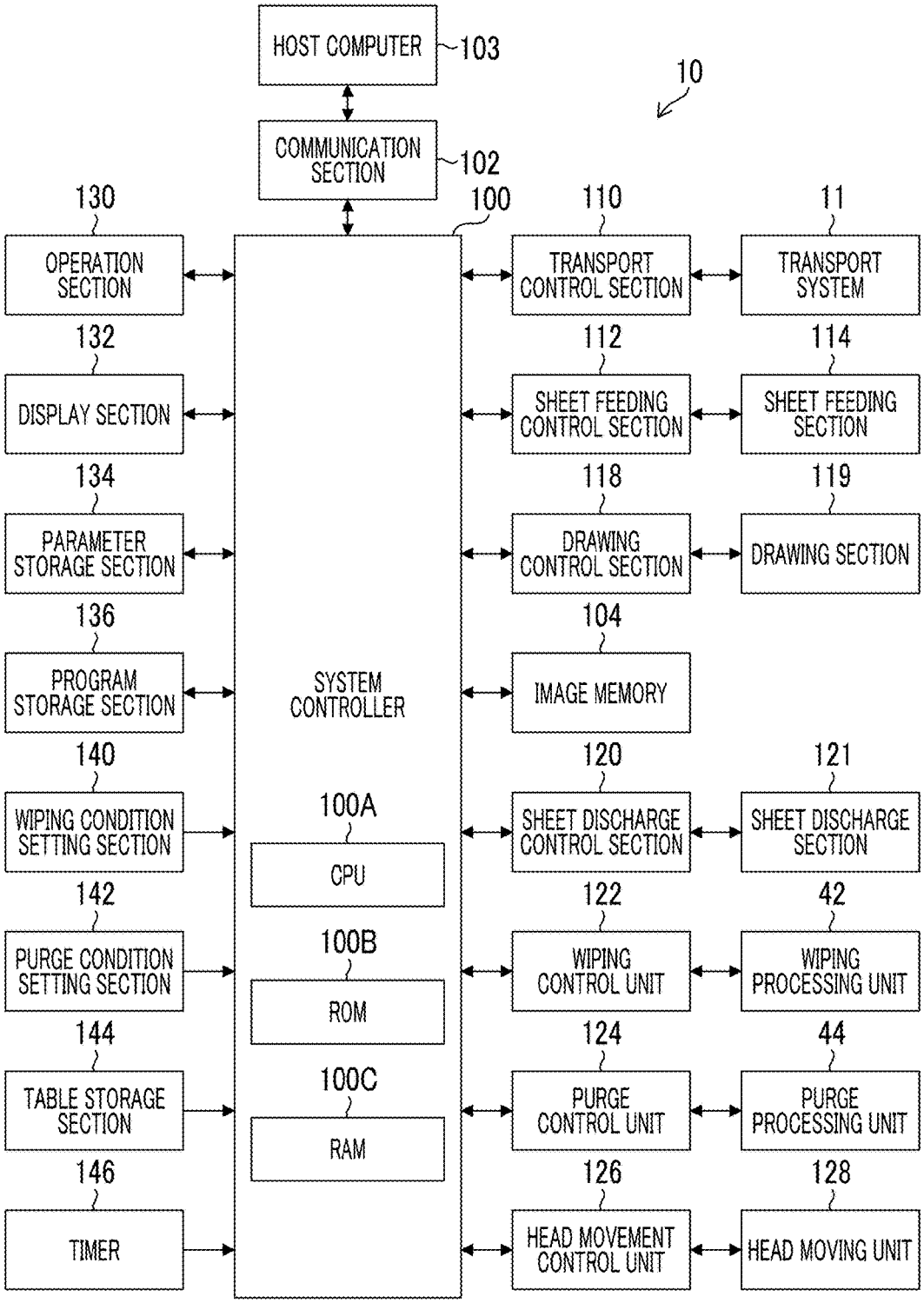
FIG. 2 is a block diagram showing the schematic configuration of a control system of the liquid discharge apparatus.

FIG. 2 is a block diagram showing the schematic configuration of a control system of the liquid discharge apparatus.

As shown in FIG. 2, the liquid discharge apparatus 10 includes a system controller 100, a communication section 102, an image memory 104, a transport control section 110, a sheet feeding control section 112, a drawing control section 118, a sheet discharge control section 120, an operation section 130, a display section 132, and the like.

The system controller 100 functions as a total control section that generally controls the respective sections of the liquid discharge apparatus 10, and functions as an arithmetic section that performs various kinds of arithmetic processing. A CPU 100A, a ROM 100B, and a RAM 100C are built in the system controller 100. CPU is the abbreviation for Central Processing Unit, and ROM is the abbreviation for Read Only Memory. RAM is the abbreviation for Random Access Memory.

The system controller 100 also functions as a memory controller that controls the writing of data to memories, such as the ROM 100B, the RAM 100C, and the image memory 104, and the reading of data from these memories.

An aspect in which memories, such as the ROM 100B and the RAM 100C, are built in the system controller 100 has been illustrated in the FIG. 2, but the memories, such as the ROM 100B and the RAM 100C, may be provided outside the system controller 100.

The communication section 102 includes a communication interface, and sends and receives data to and from a host computer 103 connected to the communication interface.

The image memory 104 functions as a temporary storage section for various data including image data, and data are read from and written in the image memory 104 through the system controller 100. Image data, which are taken from the host computer 103 through the communication section 102, are temporarily stored in the image memory 104.

The transport control section 110 controls the operation of a transport system 11 for the recording medium 12 shown in FIG. 1. The transport system 11 shown in FIG. 2 includes the drawing cylinder 14, the delivery cylinder 26, and the delivery cylinder 28 shown in FIG. 1.

The sheet feeding control section 112 shown in FIG. 2 controls an operation for starting the supply of the recording medium 12 shown in FIG. 1, an operation for stopping the supply of the recording medium 12, and the like by operating the sheet feeding section 114 in accordance with a command sent from the system controller 100.

The drawing control section 118 shown in FIG. 2 controls the operation of a drawing section 119. The drawing section 119 includes the liquid discharge heads 16C, 16M, 16Y, and 16K shown in FIG. 1.

The drawing control section 118 shown in FIG. 2 includes an image processing unit that forms dot data from input image data, a waveform generating unit that generates the waveform of a drive voltage, a waveform storage unit that stores the waveform of the drive voltage, and a drive circuit that applies a drive voltage, which has a drive waveform corresponding to the dot data, to the liquid discharge heads.

Color separation processing for separating the input image data into each color of RGB, color conversion processing for converting RGB into CMYK, correction processing, such as gamma correction and unevenness correction, and halftone processing for converting the gradation value of each pixel having each color into a gradation value smaller than an original gradation value are performed by the image processing unit.

Raster data, which are represented by a digital value in the range of 0 to 255, can be used as an example of the input image data. Dot data, which are obtained as the result of the halftone processing, may be a binary image and may be a multi-value image having three or more values.

A discharge timing and the amount of ink to be discharged at the position of each pixel are determined on the basis of the dot data generated through the processing performed by the image processing unit. That is, a drive voltage corresponding to the discharge timing and the amount of ink to be discharged at the position of each pixel and a control signal determining the discharge timing at each pixel are generated on the basis of the dot data generated through the processing performed by the image processing unit.

The drive voltage and the control signal are supplied to the liquid discharge head, and dots are formed at a drawing position by liquid that is discharged from the liquid discharge head.

The sheet discharge control section 120 discharges the recording medium 12, which is shown in FIG. 1, by operating a sheet discharge section 121 in accordance with a command sent from the system controller 100. Examples of an aspect that discharges the recording medium 12 include an aspect that stacks the recording medium 12 having been subjected to drawing on a stacker.

A wiping control unit 122 shown in FIG. 2 controls the operation of a wiping processing unit 42 in accordance with a command sent from the system controller 100. The wiping processing unit 42 performs wiping processing on the liquid discharge surfaces 30C, 30M, 30Y, and 30K of the liquid discharge heads 16C, 16M, 16Y, and 16K shown in FIG. 1. The details of the wiping processing unit 42 shown in FIG. 2 will be described below.

A purge control unit 124 controls the operation of a purge processing unit 44 in accordance with a command sent from the system controller 100. The purge processing unit 44 performs purge processing on the liquid discharge heads 16C, 16M, 16Y, and 16K shown in FIG. 1. The details of the purge processing unit 44 shown in FIG. 2 will be described below.

A head movement control unit 126 controls the operation of a head moving unit 128 in accordance with a command sent from the system controller 100. The head moving unit 128 is means for performing a head moving step of moving the liquid discharge heads 16C, 16M, 16Y, and 16K when maintenance processing is performed on the liquid discharge heads 16C, 16M, 16Y, and 16K shown in FIG. 1.

The maintenance processing of this embodiment, which is performed on the liquid discharge heads 16C, 16M, 16Y, and 16K, includes wiping processing that is performed on the liquid discharge surfaces 30C, 30M, 30Y, and 30K of the liquid discharge heads 16C, 16M, 16Y, and 16K and purge processing that is performed on the liquid discharge heads 16C, 16M, 16Y, and 16K.

Figure 3:
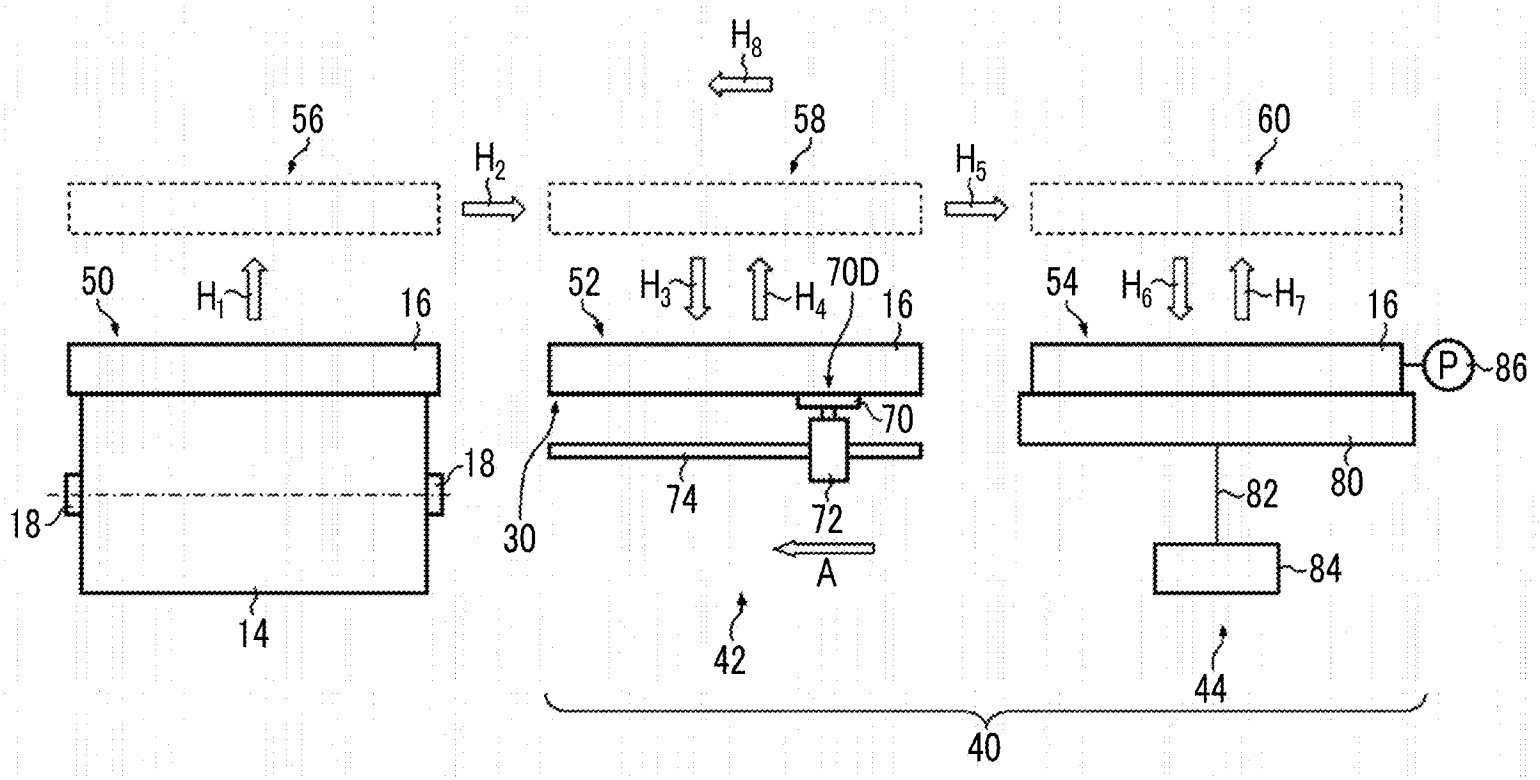
FIG. 3 is a view showing the schematic structure of a maintenance processing section.

That is, the wiping processing unit 42 and the purge processing unit 44 shown in FIG. 2 function as a maintenance processing section denoted in FIG. 3 by reference numeral 40. Further, the wiping control unit 122 and the purge control unit 124 shown in FIG. 2 function as a maintenance control section that controls the operation of the maintenance processing section. The maintenance processing section may include the head moving unit 128, and the maintenance control section may include the head movement control unit 126.

The operation section 130 includes an operation member, such as operation buttons, a keyboard, or a touch panel, and sends operation information, which is input from the operation member, to the system controller 100. The system controller 100 performs various kinds of processing in accordance with the operation information that is sent from the operation section 130.

The display section 132 includes a display device, such as a liquid crystal panel, and makes information, such as various kinds of configuration information or abnormality information of the apparatus, be displayed on the display device in accordance with a command sent from the system controller 100.

Various parameters, which are used in the liquid discharge apparatus 10, are stored in a parameter storage section 134. The various parameters, which are stored in the parameter storage section 134, are read through the system controller 100 and are set in the respective sections of the apparatus.

Programs, which are used in the respective sections of the liquid discharge apparatus 10, are stored in a program storage section 136. The various programs, which are stored in the program storage section 136, are read through the system controller 100 and are executed in the respective sections of the apparatus.

A wiping condition setting section 140 sets wiping processing conditions of the wiping processing unit 42. The wiping processing unit 42 operates on the basis of the set wiping processing conditions and performs wiping processing on the liquid discharge surfaces 30C, 30M, 30Y, and 30K of the liquid discharge heads 16C, 16M, 16Y, and 16K shown in FIG. 1.

Examples of the wiping processing conditions include the internal pressures of the liquid discharge heads 16C, 16M, 16Y, and 16K at the time of the wiping processing, the moving speed of a wiping member at the time of the wiping processing, the eccentric distance of the wiping member, and the eccentrically rotational speed of the wiping member at the time of the wiping processing.

That is, examples of an aspect of the wiping condition setting section include an aspect that includes a wiping-internal-pressure setting section for performing a wiping-internal-pressure setting step of setting the internal pressures of the liquid discharge heads 16C, 16M, 16Y, and 16K at the time of the wiping processing. The details of the wiping processing conditions will be described below.

A purge condition setting section 142 shown in FIG. 2 sets purge processing conditions of the purge processing unit 44. The purge processing unit 44 operates on the basis of the set purge processing conditions and performs purge processing on the liquid discharge heads 16C, 16M, 16Y, and 16K shown in FIG. 1.

Examples of the purge processing conditions include a purge period and the internal pressures of the liquid discharge heads 16C, 16M, 16Y, and 16K at the time of the purge processing. That is, examples of an aspect of the purge condition setting section include an aspect that includes a purge period setting section for performing a purge period setting step of setting a standard purge period, which is a processing period for standard purge processing other than post-wiping processing purge processing performed after the wiping processing, or a purge period, which is a processing period for post-wiping processing purge processing performed after the wiping processing.

Examples of the standard purge processing include purge processing that is performed as processing for initializing the apparatus and purge processing that is performed between a series of liquid discharge based on discharge data.

Further, examples of another aspect of the purge condition setting section include an aspect that includes an internal pressure setting unit for performing an internal pressure setting step of setting the internal pressure of the liquid discharge head at the time of the purge processing.

A table storage section 144 shown in FIG. 2 stores the wiping processing conditions applied to the wiping processing unit 42, the purge processing conditions applied to the purge processing unit 44, and various operating conditions of the liquid discharge apparatus 10.

The wiping condition setting section 140 can appropriately read the wiping processing conditions stored in the table storage section 144 and can set the wiping processing conditions. Further, the purge condition setting section 142 can appropriately read the purge processing conditions stored in the table storage section 144 and can set the purge processing conditions.

A timer 146 measures a period that has elapsed from the start of processing when processing for managing a processing period is performed. When the timer 146 receives a signal that is sent from the system controller 100 and represents the start of measurement, the timer 146 starts to measure the period. When the period having elapsed from the start of the measurement reaches a set period set in advance, the timer 146 sends an end signal, which represents that the period having elapsed from the start of the measurement reaches the set period set in advance, to the system controller 100.

When receiving the end signal sent from the timer 146, the system controller 100 sends a command signal, which represents that the period having elapsed from the start of processing reaches the set period, to each corresponding section of the apparatus.

The timer 146 shown in FIG. 2 functions as at least a purge period measuring unit that measures a period having elapsed from the start of the purge processing of the purge processing unit 44.

[Schematic Structure of Maintenance Processing Section]

FIG. 3 is a view showing the schematic structure of the maintenance processing section. In FIG. 3, the same components as those of FIGS. 1 and 2 are denoted by the same reference numerals as those of FIGS. 1 and 2 and the description thereof will be appropriately omitted. This also applies to the following drawings.

For convenience sake, only one of the four liquid discharge heads 16C, 16M, 16Y, and 16K shown in FIG. 1 is shown in FIG. 3.

In this specification, a liquid discharge head 16 is used as a general name of the liquid discharge heads 16C, 16M, 16Y, and 16K in a case in which the four liquid discharge heads 16C, 16M, 16Y, and 16K shown in FIG. 1 can be treated without being distinguished from each other.

Further, a liquid discharge surface 30 is also used as a general name of the liquid discharge surfaces 30C, 30M, 30Y, and 30K in a case in which the liquid discharge surfaces 30C, 30M, 30Y, and 30K can be treated without being distinguished from each other.

The maintenance processing to be described below can apply the same processing contents to the four liquid discharge heads 16C, 16M, 16Y, and 16K shown in FIG. 1.

As shown in FIG. 3, the liquid discharge apparatus 10 includes a maintenance processing section 40 that performs maintenance processing on the liquid discharge head 16. The maintenance processing section 40 includes the wiping processing unit 42 that performs wiping processing on the liquid discharge surface 30 of the liquid discharge head 16 and the purge processing unit 44 that performs purge processing on the liquid discharge head 16.

Figure 5:
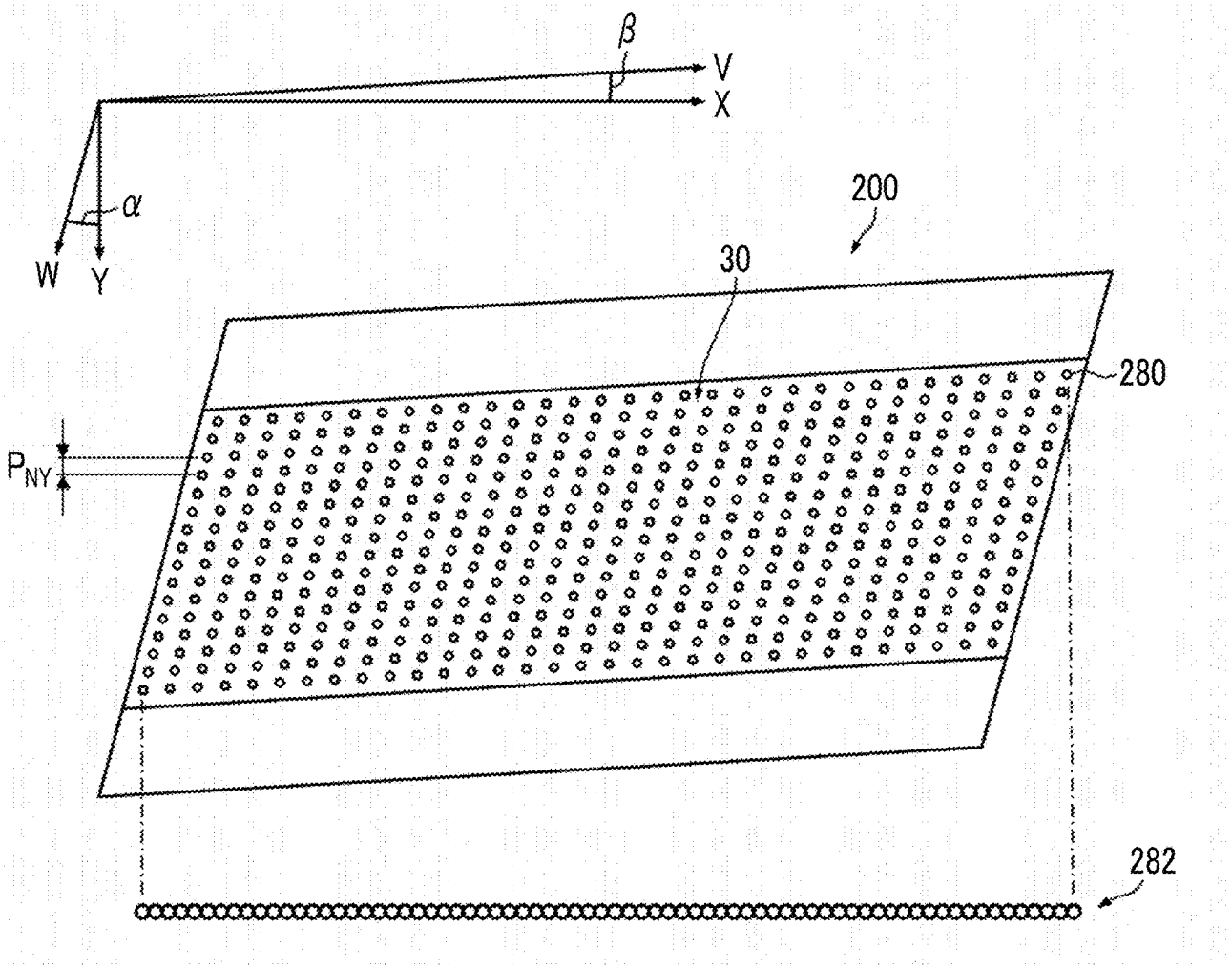
FIG. 5 is a plan perspective view of the liquid discharge surface of a head module.

The wiping processing for the liquid discharge surface 30 of the liquid discharge head 16 includes the wiping processing for the liquid discharge surface 30 and nozzle-inside wiping processing for removing adhering materials present in nozzles that are formed on the liquid discharge surface 30 and are not shown in FIG. 3. The nozzles are shown in FIG. 5 and are denoted by reference numeral 280.

The purge processing for the liquid discharge head 16 is processing for applying a pressure, which is equal to or higher than the atmospheric pressure, to liquid present in the liquid discharge head 16 and discharging the liquid, which is present in the liquid discharge head 16, to the outside of the liquid discharge head 16 through the plurality of nozzles of the liquid discharge surface 30.

The liquid discharge apparatus 10 of this embodiment can perform the post-wiping processing purge processing, which is performed after the wiping processing for the liquid discharge surface 30 of the liquid discharge head 16, and the standard purge processing.

Examples of the standard purge processing include purge processing that is performed alone to remove bubbles or liquid having increased viscosity, which is present in the nozzles, purge processing as initialization processing at the time of the start of the apparatus, and the like.

The liquid discharge head 16 shown in FIG. 3 is adapted to be capable of being moved between a drawing position 50, a wiping position 52, and a purge position 54, which are shown in FIG. 3, by the head moving unit 128 shown in FIG. 2.

The head moving unit 128 shown in FIG. 2 includes a vertical movement mechanism that moves the liquid discharge head 16 in the vertical direction and a horizontal movement mechanism that moves the liquid discharge head 16 in a horizontal direction.

A direction in which the liquid discharge head 16 is moved is not limited to the vertical direction and the horizontal direction. The vertical movement of the liquid discharge head 16 can be substituted with the oblique movement thereof including a vertical component. Further, the horizontal movement of the liquid discharge head 16 can be substituted with the oblique movement thereof including a horizontal component.

The head moving unit 128 shown in FIG. 2 may be adapted to collectively move the four liquid discharge heads 16C, 16M, 16Y, and 16K shown in FIG. 1 and may be adapted to individually move the liquid discharge heads 16C, 16M, 16Y, and 16K.

The movement of the liquid discharge head 16, which is shown in FIG. 3, to the wiping position 52 from the drawing position 50 is performed via a drawing preparation position 56 that is present directly above the drawing position 50 and a wiping preparation position 58 that is present directly above the wiping position 52. The liquid discharge head positioned at the drawing preparation position 56, the liquid discharge head positioned at the wiping preparation position 58, and the liquid discharge head positioned at a purge preparation position 60 to be described below are shown by a broken line, and the reference numerals thereof will be omitted.

White arrows, which are denoted in FIG. 3 by reference letters $H_1$, $H_2$, and $H_3$, indicate the moving direction of the liquid discharge head 16 to the drawing preparation position 56 from the drawing position 50, the moving direction of the liquid discharge head 16 to the wiping preparation position 58 from the drawing preparation position 56, and the moving direction of the liquid discharge head 16 to the wiping position 52 from the wiping preparation position 58, respectively.

When the liquid discharge head 16 is moved to the wiping position 52, the wiping processing is performed on the liquid discharge head 16 by the wiping processing unit 42. In this embodiment, the wiping processing is performed over the entire liquid discharge surface 30 of the liquid discharge head 16. The details of the wiping processing will be described below.

After the wiping processing is performed on the liquid discharge head 16, the liquid discharge head 16 is moved to the purge position 54 from the wiping position 52. The movement of the liquid discharge head 16 to the purge position 54 from the wiping position 52 is performed via the wiping preparation position 58 and a purge preparation position 60 that is present directly above the purge position 54.

White arrows, which are denoted in FIG. 3 by reference letters $H_4$, $H_5$, and $H_6$, indicate the moving direction of the liquid discharge head 16 to the wiping preparation position 58 from the wiping position 52, the moving direction of the liquid discharge head 16 to the purge preparation position 60 from the wiping preparation position 58, and the moving direction of the liquid discharge head 16 to the purge position 54 from the purge preparation position 60, respectively.

The post-wiping processing purge processing is performed on the liquid discharge head 16 moved to the purge position 54. The details of the post-wiping processing purge processing will be described below. After the post-wiping processing purge processing is performed on the liquid discharge head 16, the liquid discharge head 16 is moved to the drawing position 50 from the purge position 54.

While the liquid discharge head 16 is moved to the drawing position 50 from the purge position 54, the liquid discharge head 16 goes via the purge preparation position 60, the wiping preparation position 58, and the drawing preparation position 56. A white arrow, which is denoted in FIG. 3 by reference letter $H_7$, indicates the moving direction of the liquid discharge head 16 to the purge preparation position 60 from the purge position 54.

Further, a white arrow, which is denoted by reference letter $H_8$, indicates the moving direction of the liquid discharge head 16 to the drawing preparation position 56 from the purge preparation position 60.

An aspect that moves the liquid discharge head 16 by the head moving unit 128 shown in FIG. 2 has been exemplified in this embodiment. However, the invention can also include an aspect that includes a relative moving unit for relatively moving the liquid discharge head 16 and the drawing cylinder 14, the wiping processing unit 42, and the purge processing unit 44 instead of moving the liquid discharge head 16 or an aspect that fixes the liquid discharge head 16 and includes a drawing cylinder-moving unit for moving the drawing cylinder 14, a wiping processing unit-moving unit for moving the wiping processing unit 42, and a purge processing unit-moving unit for moving the purge processing unit 44.

[Summary of Wiping Processing Unit]

The wiping processing unit 42 shown in FIG. 3 includes a wiping member 70 that comes into contact with the liquid discharge surface 30 of the liquid discharge head 16 to wipe the liquid discharge surface 30 of the liquid discharge head 16.

Further, the wiping processing unit 42 includes a body part 72 that supports the wiping member 70 so as to allow the wiping member 70 to be eccentrically rotatable. Furthermore, the wiping processing unit 42 includes a guide part 74 that supports the wiping member 70 and the body part 72 so as to allow the wiping member 70 and the body part 72 to be integrally movable along the longitudinal direction of the liquid discharge head 16. A white arrow, which is denoted in FIG. 3 by reference letter A, indicates the moving direction of the wiping member 70 and the body part 72 when the liquid discharge surface 30 of the liquid discharge head 16 is wiped, and this direction is an aspect of a first direction. A direction, which is opposite to the arrow denoted by reference letter A, is another aspect of the first direction.

The wiping processing unit 42 shown in FIG. 3 may be provided for each of the four liquid discharge heads 16C, 16M, 16Y, and 16K shown in FIG. 1; and the wiping processing units 42 of which the number is smaller than the numbers of the liquid discharge heads are provided and the liquid discharge surfaces 30C, 30M, 30Y, and 30K of the liquid discharge heads 16C, 16M, 16Y, and 16K may be wiped by the wiping processing units 42 while the wiping processing units 42 of which the number is smaller than the numbers of the liquid discharge heads 16C, 16M, 16Y, and 16K are moved in a direction in which the liquid discharge heads 16C, 16M, 16Y, and 16K shown in FIG. 1 are arranged.

The wiping member 70 shown in FIG. 3 wipes the entire liquid discharge surface 30 by moving along the longitudinal direction of the liquid discharge head 16 over the entire length of the liquid discharge surface 30 of the liquid discharge head 16 in the longitudinal direction of the liquid discharge head 16 in a state in which a wiping surface 70D is in contact with the liquid discharge surface 30 of the liquid discharge head 16. In FIG. 3, the longitudinal direction of the liquid discharge head 16 is parallel to a moving direction A of the wiping member 70.

When the liquid discharge surface 30 of the liquid discharge head 16 is wiped by the wiping member 70, the nozzles formed on the liquid discharge surface 30 are wiped and the inside of the nozzles is also wiped by the wiping member 70. The detailed structure of the wiping processing unit 42 and the details of the wiping processing will be described.

The arrangement of the wiping processing unit 42 and the purge processing unit 44 of the maintenance processing section 40 shown in FIG. 3 is not limited to the arrangement shown in FIG. 3. For example, the wiping processing unit 42 and the purge processing unit 44 may be arranged in a direction perpendicular to the plane of FIG. 3. Further, the wiping processing unit 42 may be disposed directly above the drawing position 50.

[Structure of Purge Processing Unit]

The purge processing unit 44 shown in FIG. 3 includes a cap part 80 that receives liquid discharged from the liquid discharge head at the time of the purge processing. Further, the purge processing unit 44 includes a discharge flow passage 82 that communicates with the cap part 80, and a waste liquid tank 84 which communicates with the cap part 80 through the discharge flow passage 82 and in which waste liquid discharged from the cap part 80 is stored.

Furthermore, the purge processing unit 44 includes a pump 86 that adjusts pressure applied to the liquid present in the liquid discharge head 16. The pressure, which is applied to the liquid present in the liquid discharge head 16, is synonymous with the internal pressure of the liquid discharge head 16.

The purge processing unit 44 shown in FIG. 3 may be provided for each of the four liquid discharge heads 16C, 16M, 16Y, and 16K shown in FIG. 1; and an integrated purge processing unit corresponding to the four liquid discharge heads 16C, 16M, 16Y, and 16K shown in FIG. 1 may be provided.

Further, the purge processing units 44 of which the number is smaller than the numbers of the liquid discharge heads 16C, 16M, 16Y, and 16K are provided, and purge processing may be performed on each of the liquid discharge heads 16C, 16M, 16Y, and 16K while the purge processing units 44 are moved.

The detailed structure of the cap part 80 shown in FIG. 3 is not shown, but the cap part 80 has a structure in which a recessed portion receiving liquid discharged from the nozzles is formed on the surface of the cap part 80 to be in contact with the liquid discharge surface 30 of the liquid discharge head 16.

It is possible to discharge liquid and bubbles, which are present in the liquid discharge head 16, through the nozzles formed on the liquid discharge surface 30 by applying a pressure, which is equal to or higher than the atmospheric pressure, to the inside of the liquid discharge head 16 through the operation of the pump 86.

Liquid and bubbles, which are discharged to the cap part 80 from the inside of the liquid discharge head 16 by the purge processing, are sent to the waste liquid tank 84 through the discharge flow passage 82.

The cap part 80 may function as a protective member that protects the liquid discharge surface 30 of the liquid discharge head 16 by being mounted on the liquid discharge surface 30 of the liquid discharge head 16.

[Structure of Liquid Discharge Head]

Figure 4:
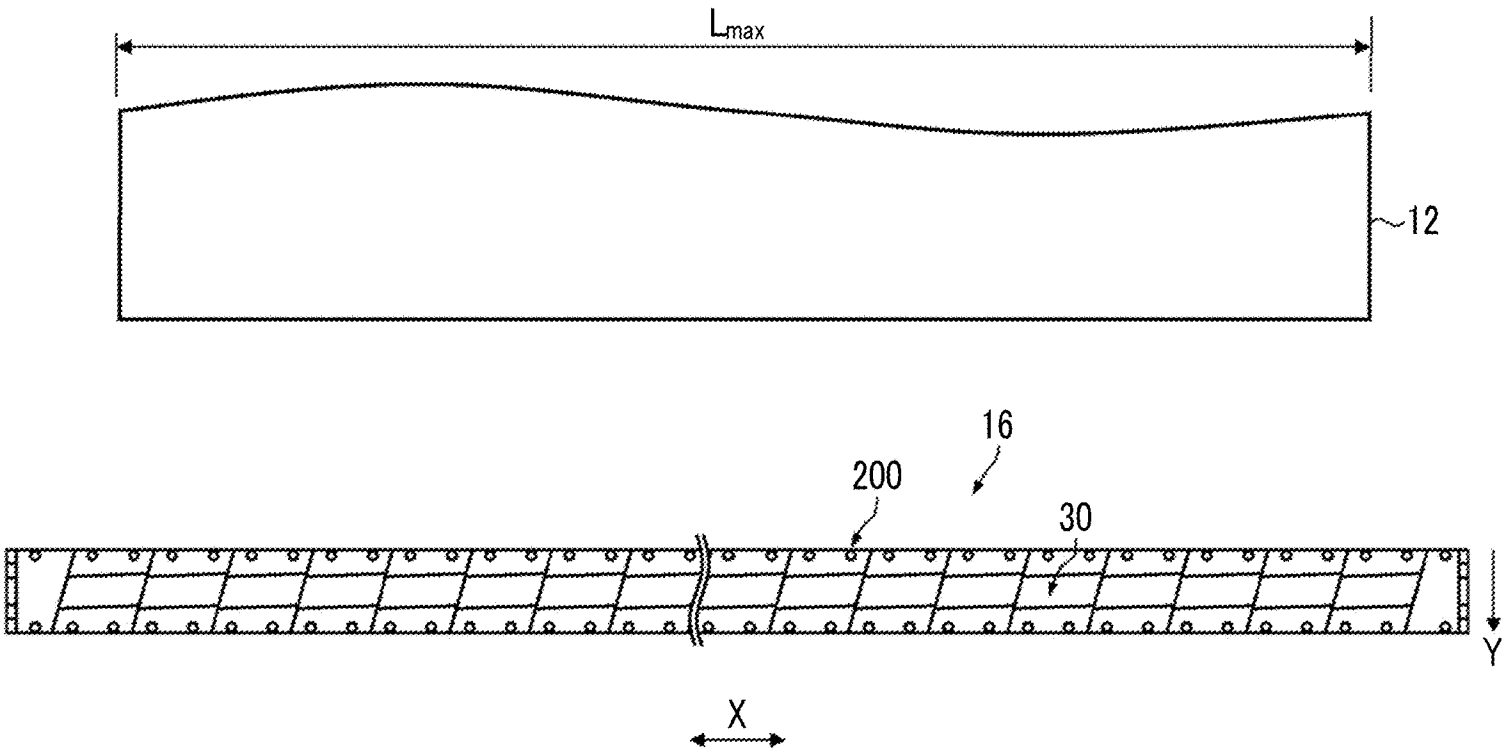
FIG. 4 is a view showing the structure of a liquid discharge head and is a plan perspective view of a liquid discharge surface.

FIG. 4 is a view showing the structure of the liquid discharge head and is a plan perspective view of the liquid discharge surface.

The liquid discharge head 16 shown in FIG. 4 has a structure in which a plurality of head modules 200 are connected to each other in the width direction of the recording medium 12 orthogonal to the transport direction of the recording medium 12. The width direction of the recording medium 12 is denoted in FIG. 4 by reference letter X. The transport direction of the recording medium 12 is denoted by reference letter Y.

The same structure can be applied to the plurality of head modules 200 of the liquid discharge head 16. Further, the head module 200 can be made to function as the liquid discharge head alone.

The liquid discharge head 16 shown in FIG. 4 has a structure in which the plurality of head modules 200 are arranged in a line along the width direction X of the recording medium 12, and is a full-line type liquid discharge head in which a plurality of nozzles are arranged over the length corresponding to the overall width $L_{max}$ of the recording medium 12 in the width direction X of the recording medium 12. The nozzles are not shown in FIG. 4. The nozzle is shown in FIG. 5 and denoted by reference numeral 280.

The liquid discharge head 16 including the plurality of head modules 200 has been exemplified in this embodiment, but one or more head modules 200 have only to be provided.

The liquid discharge head 16 having a structure in which the plurality of head modules 200 are arranged in a line along the width direction X of the recording medium 12 has been exemplified in this embodiment, but the plurality of head modules 200 may be arranged in the form of staggered arrangement in the width direction X of the recording medium 12.

FIG. 5 is a plan perspective view of the liquid discharge surface of the head module. The nozzles 280 are shown in FIG. 5 so that a part of the nozzles 280 are omitted. The head module 200 shown in FIG. 5 is a matrix head in which the plurality of nozzles 280 are arranged in the form of a matrix.

In the matrix arrangement of the nozzles 280, the head module 200 has a planar shape of a parallelogram that has an end face of a long side along a V direction inclined with respect to the width direction X of the recording medium 12 by an angle β and an end face of a short side along a W direction inclined with respect to the transport direction Y of the recording medium 12 by an angle α, and the plurality of nozzles 280 are arranged in a row direction along the V direction and a column direction along the W direction.

In other words, the matrix arrangement of the nozzles 280 is the arrangement of the nozzles 280 in which an interval between the nozzles 280 is uniform in a nozzle group 282 projected in the width direction X of the recording medium 12 where the plurality of nozzles 280 are arranged along the width direction X of the recording medium 12 when the plurality of nozzles 280 are projected in the width direction X of the recording medium 12.

Reference letter $P_{NY}$ shown in FIG. 5 denotes an interval between the nozzles 280 of a nozzle group, which corresponds to the column direction along the W direction, in a direction orthogonal to the moving direction A of the wiping member 70 shown in FIG. 3. The direction orthogonal to the moving direction A of the wiping member 70 is parallel to a lateral direction of the liquid discharge head 16 shown in FIG. 3, and is parallel to the lateral direction of the head module 200 shown in FIG. 4 and the transport direction Y of the recording medium 12.

Figure 8:
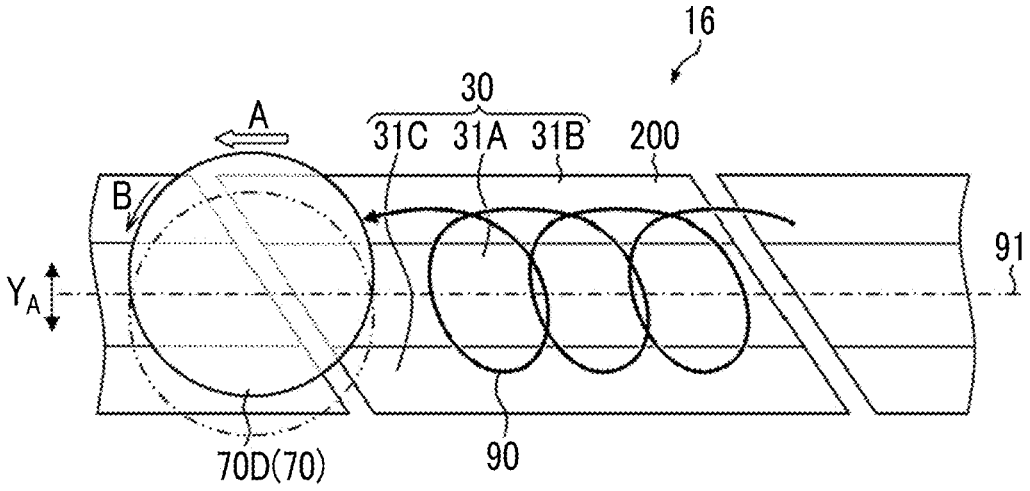
FIG. 8 is a view schematically illustrating wiping processing.

The lateral direction of the liquid discharge head 16, which is a second direction orthogonal to the first direction, is shown in FIG. 8 and denoted by reference letter $Y_A$.

The arrangement of the nozzles 280 is not limited to an aspect shown in FIG. 5, and can also include an aspect in which the plurality of nozzles 280 are arranged in the form of a matrix along the row direction, which is along the width direction X of the recording medium 12, and the column direction that obliquely crosses the width direction X of the recording medium 12. That is, two-dimensional arrangement can be applied as the arrangement of the plurality of nozzles 280.

Examples of the internal structure of the liquid discharge head 16 include a structure including a pressure chamber that communicates with the nozzles 280 shown in FIG. 5, a discharge-pressure generating element that is disposed in the pressure chamber, and a supply flow passage that communicates with the pressure chamber through a throttle portion.

The liquid discharge head 16 may have a structure in which a plurality of thin films on which structures, such as flow passages, are formed are laminated, and may have a structure in which working using a chemical method or working using a physical method is performed on a substrate made of silicon or the like to form structures, such as flow passages.

Examples of a discharge system for the liquid discharge head 16 include: a piezoelectric system that discharges liquid, which is present in a pressure chamber, form nozzles 280 by deforming the pressure chamber through the deflection of a piezoelectric element; and a thermal system that discharges liquid form nozzles 280 by heating liquid, which is present in a pressure chamber, and using a film boiling phenomenon of the liquid that is present in the pressure chamber.

A shape in which the diameter of an opening on the liquid discharge surface 30 is smaller than the diameter of the opening inside the liquid discharge head, a shape in which the diameter of an opening on the liquid discharge surface is equal to the diameter of the opening inside the liquid discharge head, and the like can be applied to the nozzle 280.

[Description of Wiping Processing Unit]

[Schematic Structure of Wiping Processing Unit]

Figure 6:
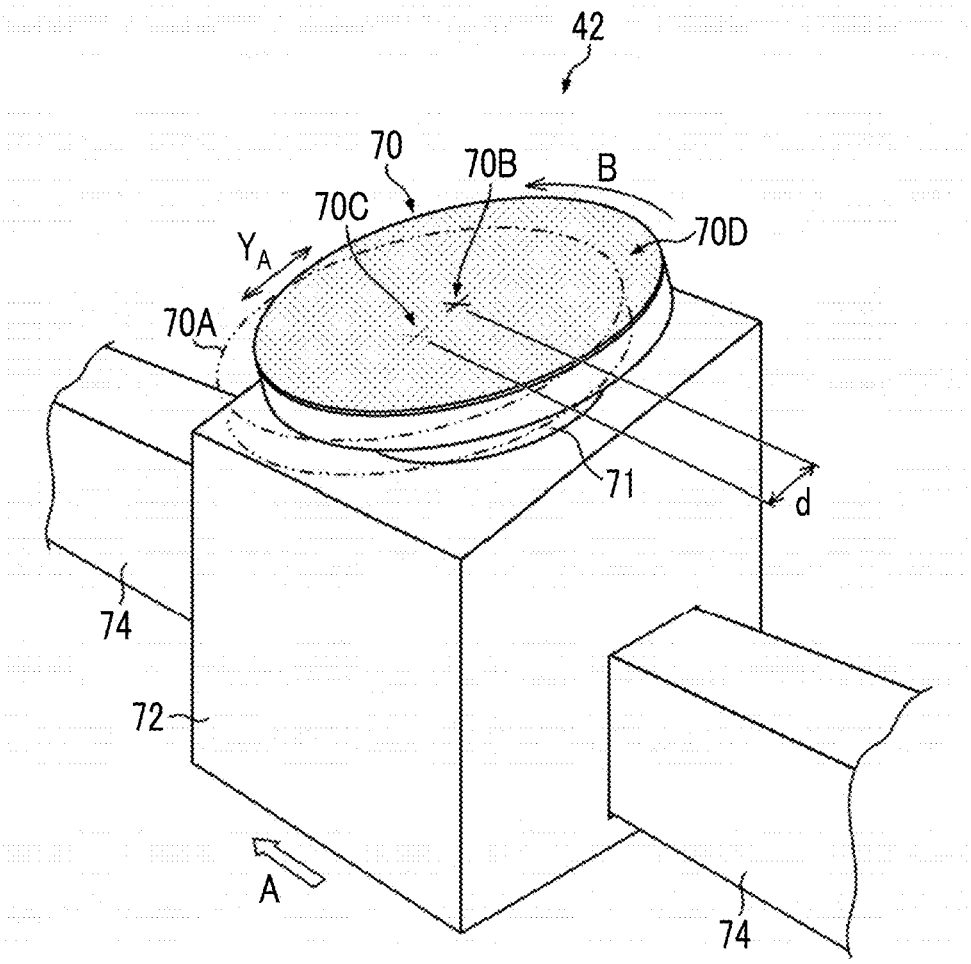
FIG. 6 is a view showing the schematic structure of a wiping processing unit.

FIG. 6 is a view showing the schematic structure of the wiping processing unit. Only a part of the guide part 74, which is shown in FIG. 3, is shown in FIG. 6.

The wiping processing unit 42 shown in FIG. 6 includes the wiping member 70, the body part 72, and the guide part 74. The wiping member 70 is supported by a support shaft 71 so as to be eccentrically rotatable about a center 70C of eccentric rotation as the center of rotation. In FIG. 6, a curve arrow denoted by reference letter B represents an aspect of the eccentric rotation direction of the wiping member 70.

The support shaft 71 is connected to a rotation mechanism (not shown) that is built in the body part 72. The rotation mechanism (not shown) is connected to the rotating shaft of a motor (not shown) that is built in the body part 72. When the rotating shaft of the motor (not shown) is rotated, the support shaft 71 is rotated and the wiping member 70 is eccentrically rotated about the center 70C of eccentric rotation as the center of rotation. In FIG. 6, the wiping member, which is eccentrically rotating, is denoted by reference numeral 70A and is shown by a two-dot chain line.

Reference numeral 70B of FIG. 6 denotes a center of noneccentric rotation as the center of rotation when the wiping surface 70D of the wiping member 70 is rotated without being eccentric. A distance between the center 70B of noneccentric rotation and the center 70C of eccentric rotation is referred to as an eccentric distance d. Reference letter $Y_A$ shown in FIG. 6 denotes the lateral direction of the liquid discharge head 16 shown in FIG. 4, and denotes the direction of a straight line that connects the center 70B of noneccentric rotation with the center 70C of eccentric rotation.

The wiping member 70 includes the wiping surface 70D that is to be in contact with the liquid discharge surface 30 of the liquid discharge head 16 shown in FIG. 3. When the wiping surface 70D and the liquid discharge surface 30 of the liquid discharge head 16 are in contact with each other, the wiping member 70 is supported in parallel to the liquid discharge surface 30 and the wiping member 70 is eccentrically rotated in a plane parallel to the liquid discharge surface 30.

Since the liquid discharge surfaces 30C, 30M, 30Y, and 30K of the four liquid discharge heads 16C, 16M, 16Y, and 16K shown in FIG. 1 are inclined with respect to the horizontal plane, the wiping member 70 is supported so as to be inclined with respect to the horizontal plane 1 shown in FIG. 1 in response to the inclination of the liquid discharge surfaces 30C, 30M, 30Y, and 30K when wiping the liquid discharge surfaces 30C, 30M, 30Y, and 30K of the liquid discharge heads 16C, 16M, 16Y, and 16K shown in FIG. 1.

The wiping surface 70D shown in FIG. 6 includes raised yarn that is raised irregularities. The raised yarn is not shown in FIG. 6. The raised yarn is shown in FIG. 7 and denoted by reference numeral 75B.

The wiping surface 70D of which the planar shape is a circular shape has been exemplified in this embodiment, but the planar shape of the wiping surface 70D is not limited to a circular shape and may be a polygonal shape, such as a square shape. In a case in which the planar shape of the wiping surface 70D is a shape other than a circular shape, the diameter of the wiping member or the wiping surface corresponds to the maximum length of the wiping member or the wiping surface. Further, in a case in which the planar shape of the wiping surface 70D is a shape other than a circular shape, the center 70B of noneccentric rotation corresponds to the center of gravity of the wiping surface 70D.

[Description of Wiping Surface of Wiping Member]

Figure 7:
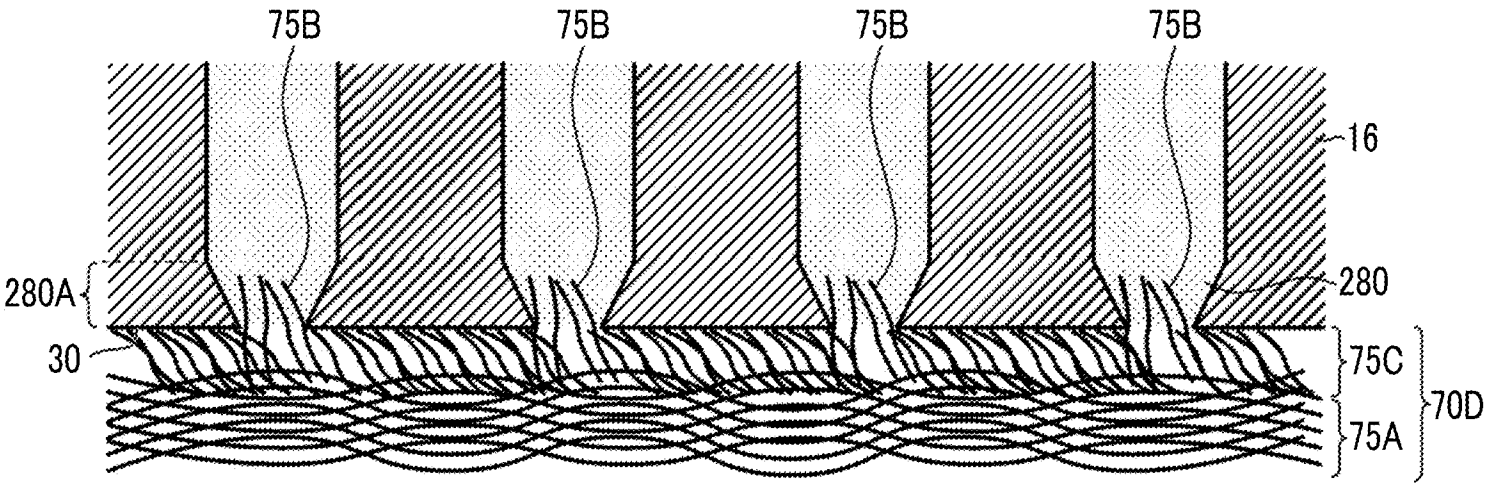
FIG. 7 is a view illustrating the wiping surface of a wiping member.

FIG. 7 is a view illustrating the wiping surface of the wiping member. FIG. 7 shows the enlarged cross-section of a portion, which is positioned near the nozzles 280, of the liquid discharge head 16 and the cross-section of a portion of the wiping surface 70D.

The wiping surface 70D includes raised yarn 75B that is raised from a ground texture portion 75A. While the raised yarn 75B is thrust into each of the nozzles 280 formed on the liquid discharge surface 30, the liquid discharge surface 30 is wiped.

Accordingly, since dirt, which is present inside the nozzle 280, particularly, on a tapered portion 280A, can be scraped off by the raised yarn 75B, the inside of the nozzle 280 can also be cleaned. Since being able to be caught by the ground texture portion 75A, dirt scraped off from the inside of the nozzle 280 and dirt present on the liquid discharge surface 30 can be wiped off without remaining on the liquid discharge surface 30. At this time, dirt present on the liquid discharge surface 30 can also be efficiently scraped off by the action of the raised yarn 75B.

One of purposes of using the wiping surface 70D including raised yarn 75B, which is raised irregularities, is to scrape off dirt, which is present inside the nozzle 280, by the raised yarn 75B. Accordingly, the wiping surface 70D employs a structure that has surface nature and a surface shape allowing a portion of the raised yarn 75B to be thrust into the nozzles 280 at the time of the wiping processing.

The wiping surface 70D is appropriately selected according to the size, the shape, and the like of the opening of the nozzle 280. That is, the wiping surface 70D, which includes the raised yarn 75B having a thickness and a length allowing the raised yarn 75B to be thrust into the nozzles 280 formed on the liquid discharge surface 30, is used.

Further, it is preferable that the raised yarn 75B has appropriate elasticity, that is, so-called resilience so as to be easily thrust into the nozzle 280 at the time of the wiping processing. Since the elasticity of the raised yarn 75B deteriorates when the length of the raised yarn 75B is set to be too long, it is difficult for the raised yarn 75B to be thrust into the nozzles 280. Accordingly, it is preferable that the raised yarn 75B is adjusted to have an appropriate length.

For example, in a case in which the liquid discharge surface 30 on which tapered nozzles 280, of which the diameter of the opening is 16 μm and the length of the tapered portion 280A is 50 are formed is to be wiped, it is preferable that the diameter of the raised yarn 75B forming a raised portion 75C is set to 5 μm or less. Further, it is preferable that the length of the raised yarn 75B is in the range of 10 μm to 50 μm.

That is, it is preferable that the diameter of the raised yarn 75B is set to a half or less of the diameter of the nozzle 280 on the liquid discharge surface 30. Accordingly, the raised yarn 75B can be made to be thrust into the nozzles 280 at the time of the wiping processing.

Furthermore, it is preferable that the length of the raised yarn 75B is set to a length corresponding to the length of the tapered portion 280A in the case of the nozzle 280 having the tapered portion 280A. Accordingly, since the raised yarn 75B can be made to be thrust into the nozzles 280, dirt present inside the nozzles 280 can be sufficiently scraped off.

If the raised yarn 75B is left inside the nozzles 280, the raised yarn 75B becomes new foreign matters. For this reason, it is preferable that the raised yarn 75B is firmly fixed to the ground texture portion 75A. Moreover, it is preferable that pieces of the raised yarn 75B are densely provided so that the raised portion 75C allows dirt to be efficiently caught between pieces of the raised yarn 75B.

Examples of an aspect, which includes the raised yarn 75B functioning as raised irregularities on the wiping surface 70D, include a sheet that includes the raised yarn 75B on the surface thereof and an aspect in which a web is pasted to the wiping surface 70D.

[Description of Operation of Wiping Member]

FIG. 8 is a view schematically illustrating the wiping processing.

FIG. 8 schematically shows a state in which the wiping surface 70D comes into contact with the liquid discharge surface 30 of the liquid discharge head 16 to wipe the liquid discharge surface 30. Some of the plurality of head modules 200 shown in FIG. 3 are shown in FIG. 8.

As shown in FIG. 8, the liquid discharge surface 30 includes a nozzle forming portion 31A in which nozzles not shown in FIG. 8 are formed, and support portions 31B and 31C that support the nozzle forming portion 31A from both sides of the nozzle forming portion 31A in the lateral direction $Y_A$ of the liquid discharge head 16.

The lateral direction $Y_A$ of the liquid discharge head 16 shown in FIG. 8 is parallel to the transport direction Y of the recording medium 12 shown in FIG. 4 when the liquid discharge head 16 is disposed at the drawing position 50 of FIG. 3.

The wiping surface 70D is eccentrically rotated about the center of eccentric rotation of the wiping surface 70D that is shifted from the center of noneccentric rotation of the wiping surface 70D in a direction parallel to the lateral direction $Y_A$ of the liquid discharge head 16.

The center of noneccentric rotation of the wiping surface 70D and the center of eccentric rotation of the wiping surface 70D are shown in FIG. 6 and denoted by reference numerals 70B and 70C, respectively.

A track, which includes overlapping areas shown in FIG. 8 and denoted by reference numeral 90 and draws arcs, is a trajectory that is drawn on the liquid discharge surface 30 by an arbitrary wiping point on the wiping surface 70D. Further, reference numeral 91 denotes a trajectory along which the center 70C of eccentric rotation of the wiping surface 70D passes. Examples of the arbitrary wiping point on the wiping surface 70D include one or a plurality of pieces of raised yarn 75B shown in FIG. 7.

A large number of wiping points, each of which draws the same trajectory as the trajectory shown in FIG. 8, are present on the wiping surface 70D and the trajectories drawn by the large number of wiping points overlap each other. In this case, since the liquid discharge surface 30 and the inside of the nozzles are uniformly wiped in multiple directions, dried and hardened liquid, which adheres to the liquid discharge surface 30 and the inside of the nozzles, is removed.

Examples of one cause of the deterioration of the discharge state of the liquid discharge head 16 include the drying and hardening of liquid. When liquid is dried and hardened, it is difficult to recover the deterioration of the discharge state.

For example, even though maintenance, which can remove liquid adhering to the liquid discharge surface 30 and not dried and hardened, is performed, it is particularly difficult to remove dried and hardened liquid that adheres to the inside of the nozzle.

That is, when the wiping surface 70D is eccentrically rotated as shown in FIG. 8 and the wiping surface 70D is moved along the longitudinal direction of the liquid discharge head 16 in a state in which the raised yarn 75B provided on the wiping surface 70D is thrust into the nozzles 280 as shown in FIG. 7, the raised yarn 75B shown in FIG. 7 can come into uniform contact with the entire circumference of the opening of each of the nozzles. Accordingly, an adhering material, such as dried and hardened liquid adhering to the inside of each nozzle, can be uniformly removed over the entire circumference of the opening of each of the nozzles.

Since the wiping surface 70D shown in FIG. 8 has a diameter that is equal to or larger than the entire length of the liquid discharge head 16 in the lateral direction, wiping processing can be performed on the entire liquid discharge surface 30 even though the wiping member 70 is moved relative to the liquid discharge surface 30 only one time over the entire length of the liquid discharge head 16 in the longitudinal direction.

The diameter of the wiping surface 70D has only to be equal to or larger than at least the entire length of the nozzle forming portion 31A in the lateral direction $Y_A$ of the liquid discharge head 16.

FIG. 8 illustrates an aspect in which the center 70C of eccentric rotation of the wiping surface 70D passes along a straight line bisecting the liquid discharge head 16 of the liquid discharge surface 30 in the lateral direction $Y_A$. A trajectory 91 of the center 70C of eccentric rotation of the wiping surface 70D can be moved in the lateral direction $Y_A$ of the liquid discharge head 16 within a range satisfying a condition in which the entire area of the nozzle forming portion 31A can be wiped when the wiping surface 70D is moved over the entire length of the liquid discharge head 16 in the longitudinal direction.

A period in which the liquid discharge surface 30 and the wiping surface 70D are in contact with each other may be further lengthened to further improve the effect of the wiping processing. For example, the moving speed of the wiping member 70 may be reduced or the eccentrically rotational speed of the wiping member 70 may be reduced.

When the moving speed of the wiping member 70 is reduced, a wiping processing period is lengthened. Likewise, when the eccentrically rotational speed of the wiping member 70 is reduced, a wiping processing period is lengthened. The moving speed of the wiping member 70 and the eccentrically rotational speed of the wiping member 70 are determined in consideration of both the wiping processing period and the effect of the wiping processing.

[Description of Post-Wiping Processing Purge Processing]

In a method for maintenance of a liquid discharge head of this embodiment, post-wiping processing purge processing is performed on the liquid discharge head 16 after the wiping processing is performed on the liquid discharge surface 30 of the liquid discharge head 16 by the wiping member 70 shown in FIG. 6.

When the wiping surface 70D including the raised yarn 75B and the raised portion 75C shown in FIG. 7 is used for the wiping processing for the liquid discharge surface 30, bubbles are trapped in the nozzles 280. In this case, the discharge performance of the liquid discharge head 16 deteriorates due to the bubbles trapped in the nozzles 280.

Accordingly, the post-wiping processing purge processing is performed on the liquid discharge head 16 to discharge the bubbles, which are trapped in the nozzles 280, to the outside of the nozzles 280, so that the discharge performance of the liquid discharge head 16 is recovered. The details of purge processing conditions of the post-wiping processing purge processing will be described below.

[Description of Procedure of Method for Maintenance of Liquid Discharge Head]

[Description of the Entire Procedure]

Figure 9:
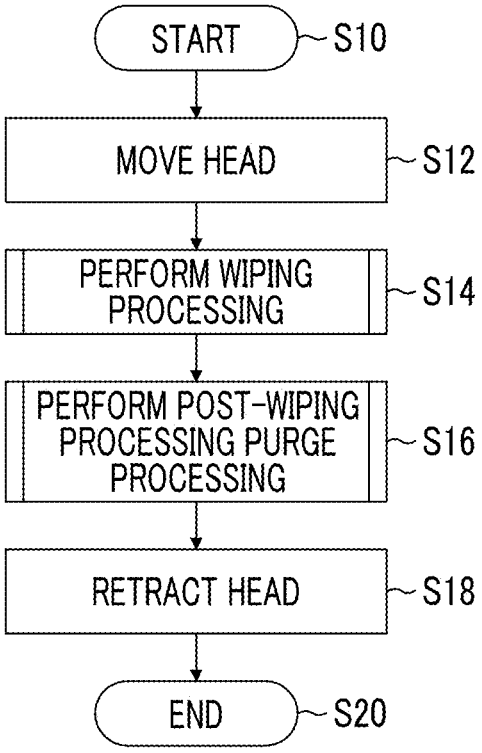
FIG. 9 is a flow chart illustrating the flow of a procedure of a method for maintenance of a liquid discharge head according to an embodiment of the invention.

FIG. 9 is a flow chart illustrating the flow of a procedure of a method for maintenance of a liquid discharge head according to an embodiment of the invention. The method for maintenance of a liquid discharge head is started in a start step S10 illustrated in FIG. 9.

First, in a head moving step S12, the liquid discharge head 16 is moved to the wiping preparation position 58 from the drawing position 50 shown in FIG. 3.

Next, a wiping processing step S14 illustrated in FIG. 9 is performed. In the wiping processing step S14, the liquid discharge head 16 is moved to the wiping position 52 from the wiping preparation position 58 shown in FIG. 3. Then, wiping processing is performed on the liquid discharge head 16 by the wiping member 70.

After the wiping processing is performed on the liquid discharge head 16, the liquid discharge head 16 is moved to the wiping preparation position 58 from the wiping position 52 shown in FIG. 3.

A post-wiping processing purge processing step S16 is performed after the wiping processing step S14 illustrated in FIG. 9. In the post-wiping processing purge processing step S16, the liquid discharge head 16 is moved to the purge position 54 from the wiping preparation position 58 shown in FIG. 3 and purge processing is performed on the liquid discharge head 16.

After the purge processing is performed on the liquid discharge head 16, the liquid discharge head 16 is moved to the purge preparation position 60 from the purge position 54 shown in FIG. 3.

After the wiping processing step S14 and the post-wiping processing purge processing step S16 illustrated in FIG. 9 are performed, a head retracting step S18 is performed. In the head retracting step S18, the liquid discharge head 16 is moved to the drawing position 50 from the purge preparation position 60 shown in FIG. 3.

The liquid discharge head 16 may wait for the start of the next drawing job in a state in which the cap part 80 is mounted on the liquid discharge head 16 at the purge position 54. That is, a drawing-start waiting step may be performed instead of the head retracting step S18 of FIG. 9.

When the liquid discharge head 16 waits for the start of the next drawing job in a state in which the cap part 80 is mounted on the liquid discharge head 16 shown in FIG. 3, the drying of liquid present in the nozzles is suppressed in a period in which the liquid discharge head 16 waits for the start of the next drawing job.

The method for maintenance of a liquid discharge head is ended in an ending step S20 illustrated in FIG. 9.

[Description of Wiping Processing Step]

Figure 10:
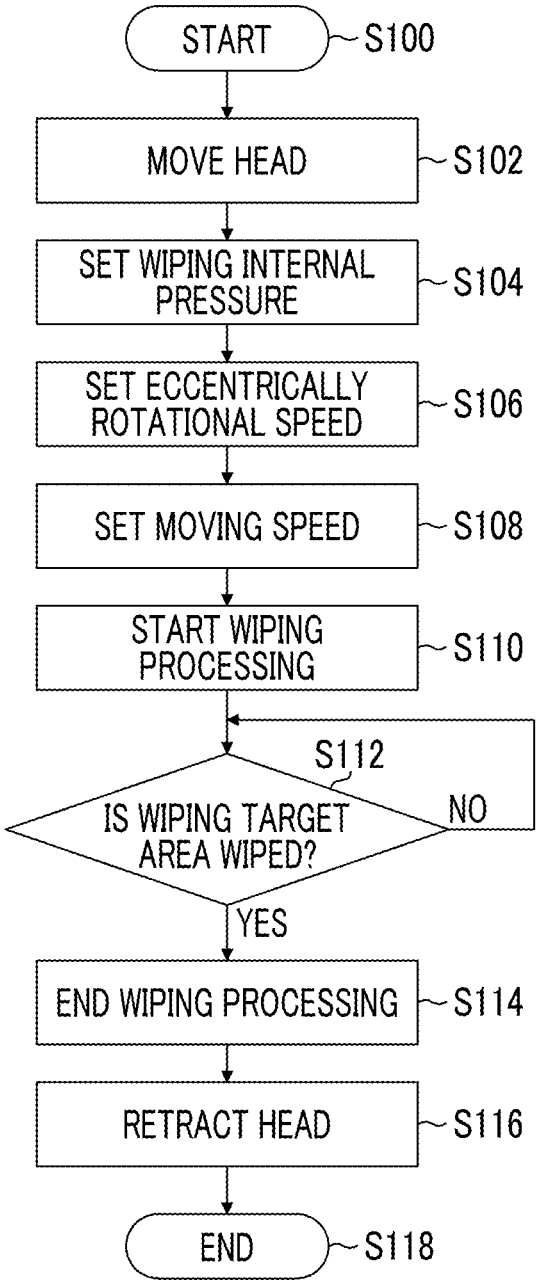
FIG. 10 is a flow chart illustrating the flow of a procedure of a wiping processing step.

FIG. 10 is a flow chart illustrating the flow of a procedure of the wiping processing step. A series of processing of the wiping processing step are started in a start step S100 as illustrated in FIG. 10. First, in a head moving step S102, the liquid discharge head 16 is moved to the wiping position 52 from the wiping preparation position 58 shown in FIG. 3.

The head moving step S102 illustrated in FIG. 10 and the head moving step S12 illustrated in FIG. 9 may be integrated as a head moving step.

Next, the internal pressure of the liquid discharge head 16 shown in FIG. 3 is set in a wiping-internal-pressure setting step S104 illustrated in FIG. 10. That is, the set value of the pump 86 is set to a value that is set at the time of the wiping processing. The detail of the internal pressure of the liquid discharge head 16 at the time of the wiping processing will be described below.

After that, the eccentrically rotational speed of the wiping member 70 shown in FIG. 6 is set in an eccentrically rotational speed setting step S106 illustrated in FIG. 10, and the moving speed of the wiping member 70 shown in FIG. 6 is set in a moving speed setting step S108 illustrated in FIG. 10. An eccentric distance adjusting step of adjusting the eccentric distance d is performed in a case in which the eccentric distance d shown in FIG. 6 needs to be adjusted.

Various kinds of setting at the time of the wiping processing, such as the setting of the wiping internal pressure of the liquid discharge head 16 shown in FIG. 3, the eccentrically rotational speed of the wiping member 70, the moving speed of the wiping member 70, and the pressing force of the wiping member 70 applied to the liquid discharge surface 30 are performed by the wiping condition setting section 140 of FIG. 2.

Steps of performing various kinds of setting at the time of the wiping processing, which include the wiping-internal-pressure setting step S104, the eccentrically rotational speed setting step S106, and the moving speed setting step S108 illustrated in FIG. 10, may be integrated as a wiping condition setting step.

After the wiping processing conditions are set through the wiping-internal-pressure setting step S104, the eccentrically rotational speed setting step S106, and the moving speed setting step S108 illustrated in FIG. 10, the wiping processing for the liquid discharge surface 30 shown in FIG. 3 is started in a wiping processing start step S110.

That is, the wiping surface 70D comes into contact with the liquid discharge surface 30. In this case, a pressing force, which allows the raised yarn 75B of the wiping surface 70D to be thrust into the openings of the nozzles 280, is applied to the wiping member 70. The wiping member 70 is moved in the moving direction A of the wiping member 70 in a state in which the raised yarn 75B of the wiping surface 70D is thrust into the openings of the nozzles 280.

After the wiping processing for the liquid discharge surface 30 is started, whether or not wiping processing for a wiping target area, which is set in advance, has ended is monitored in a monitoring step S112 illustrated in FIG. 10. If the determination of NO in the monitoring step S112 is made, that is, the wiping processing for the wiping target area has not ended, the monitoring step S112 is continued.

On the other hand, if the determination of YES in the monitoring step S112 is made, that is, the wiping processing for the wiping target area has ended, the processing proceeds to a head retracting step S116 through a wiping processing ending step S114. In the head retracting step S116, the liquid discharge head 16 is moved to the wiping preparation position 58 from the wiping position 52 shown in FIG. 3. The head retracting step S116 illustrated in FIG. 10 and the head retracting step S18 illustrated in FIG. 9 may be integrated as a head retracting step.

The timer 146 shown in FIG. 2 may be used for the monitoring of the wiping processing period in the monitoring step S112 illustrated in FIG. 10, and a position detection sensor (not shown), which detects the position of the wiping member 70, may be used for the monitoring.

In this embodiment, the entire liquid discharge surface 30 serves as the wiping target area. A part of the liquid discharge surface 30 may be selectively set as the wiping target area.

The liquid discharge head 16 shown in FIG. 3 is moved to the wiping preparation position 58 by the head retracting step S116 illustrated in FIG. 10. Then, a series of processing of the wiping processing step are ended in an ending step S118 illustrated in FIG. 10. After the series of processing of the wiping processing step illustrated in FIG. 10 are ended, the processing proceeds to the post-wiping processing purge processing step S16 illustrated in FIG. 9.

[Description of Procedure of Post-Wiping Processing Purge Processing Step]

Figure 11:
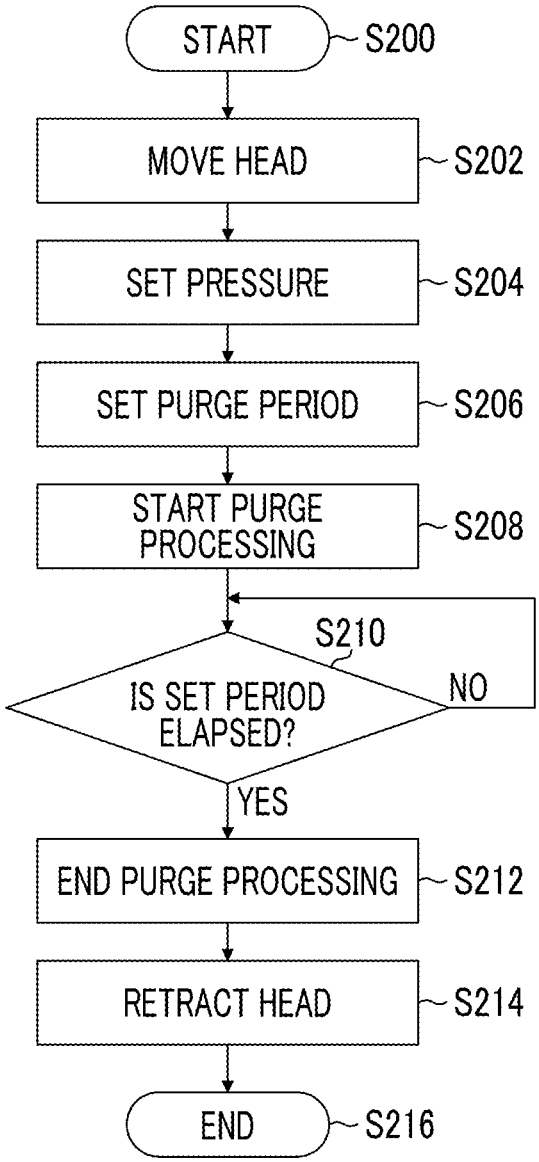
FIG. 11 is a flow chart illustrating the flow of a procedure of a post-wiping processing purge processing step.

FIG. 11 is a flow chart illustrating the flow of a procedure of the post-wiping processing purge processing step. A series of processing of the post-wiping processing purge processing step are started in a start step S200 illustrated in FIG. 11. First, in a head moving step S202, the liquid discharge head 16 is moved to the purge preparation position 60 from the wiping preparation position 58 shown in FIG. 3 and the liquid discharge head 16 is further moved to the purge position 54 from the purge preparation position 60.

Next, the internal pressure of the liquid discharge head 16 shown in FIG. 3 at the time of the purge processing is set in a pressure setting step S204 illustrated in FIG. 11. The internal pressure of the liquid discharge head 16 at the time of the purge processing is set to a pressure that is equal to or higher than the atmospheric pressure.

Next, the purge period of the liquid discharge head 16 shown in FIG. 3 is set in a purge period setting step S206 illustrated in FIG. 11. After purge processing conditions are set in the pressure setting step S204 and the purge period setting step S206 illustrated in FIG. 11, the purge processing for the liquid discharge head 16 shown in FIG. 3 is started in a purge processing start step S208.

Setting at the time of the purge processing, such as the setting of the internal pressure and the purge period of the liquid discharge head 16 shown in FIG. 3, is performed by the purge condition setting section 142 shown in FIG. 2. Steps of performing the setting of the purge processing conditions including the pressure setting step S204 and the purge period setting step S206 illustrated in FIG. 11 may be integrated as a purge condition setting step.

After purge processing is started in the purge processing start step S208 illustrated in FIG. 11, the internal pressure of the liquid discharge head 16 shown in FIG. 3 is adjusted to the pressure, which is equal to or higher than the atmospheric pressure and is set in the pressure setting step S204 of FIG. 11, and liquid present in the liquid discharge head 16 shown in FIG. 3 is discharged through the nozzles 280 shown in FIG. 5.

Next, a period lapse monitoring step S210 illustrated in FIG. 11 is started. A period elapsed from the start of the purge processing is monitored in the period lapse monitoring step S210. If the determination of NO in the period lapse monitoring step S210 is made, that is, the period elapsed from the start of the purge processing does not exceed the purge period set in the purge period setting step S206, the period lapse monitoring step S210 is continued.

On the other hand, if the determination of YES in the period lapse monitoring step S210 is made, that is, the period elapsed from the start of the purge processing has exceeded the purge period set in the purge period setting step S206, the internal pressure of the liquid discharge head 16 shown in FIG. 3 is adjusted to a set value, which is obtained at the time of the drawing, in a purge processing ending step S212 and purge is ended.

The timer 146 shown in FIG. 2 is used for the monitoring of the purge period in the period lapse monitoring step S210 illustrated in FIG. 11.

After the purge of the liquid discharge head 16 is ended, the processing proceeds to a head retracting step S214 illustrated in FIG. 11, the cap part 80 is separated from the liquid discharge head 16 shown in FIG. 3, and the liquid discharge head 16 is moved to the purge preparation position 60 from the purge position 54.

When the liquid discharge head 16 is moved to the purge preparation position 60 from the purge position 54, a series of processing of the purge processing step is ended in an ending step S216.

Since the wiping processing for the liquid discharge surface 30 of the liquid discharge head 16 and the purge processing for the liquid discharge head 16 are used together in this way, the discharge performance of the liquid discharge head 16, which has deteriorated due to use, can be recovered.

[Description of Functional Effects]

Figure 12A:
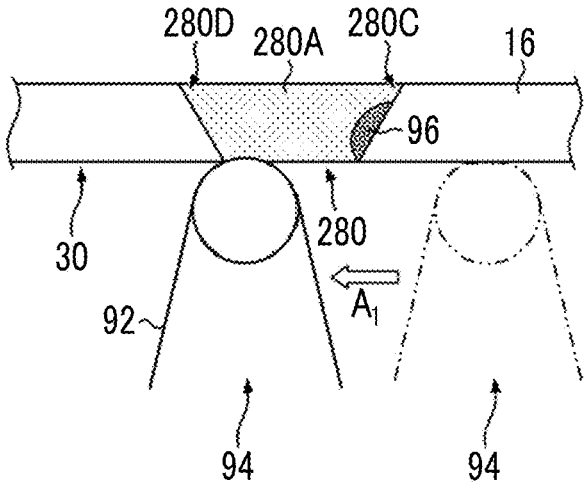
FIG. 12A is a view illustrating the internal state of a nozzle after wiping processing using a wiping member that does not include raised irregularities on the wiping surface thereof.
Figure 12B:
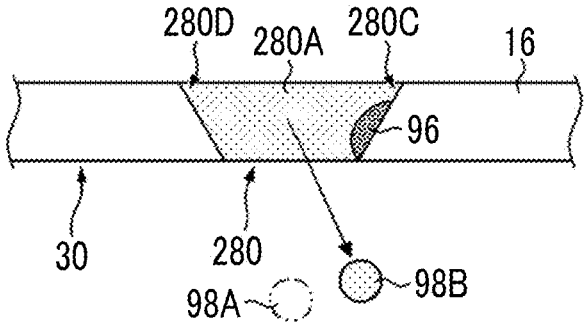
FIG. 12B is a view illustrating flying bending when an adhering material adheres to the inside of the nozzle.

FIG. 12A is a view illustrating the internal state of the nozzle after wiping processing using a wiping member that does not include raised irregularities on the wiping surface thereof. FIG. 12B is a view illustrating flying bending when an adhering material adheres to the inside of the nozzle.

A non-raised wiping sheet 92 shown in FIG. 12A is, for example, a sheet-like wiping member that includes the ground texture portion 75A, which is shown in FIG. 7, on the surface thereof. When the liquid discharge surface 30 of the liquid discharge head 16 is wiped by a wiping member 94 including the non-raised wiping sheet 92, an adhering material 96 remains in the nozzle 280.

When a case in which the wiping member 94 shown in FIG. 12A by a two-clot chain line is moved to the position of the wiping member 94 shown by a solid line is thought, the adhering material 96 is likely to remain on an upstream-side surface 280C of a tapered portion 280A of the nozzle 280 in a moving direction $A_1$ of the wiping member 94.

The moving direction $A_1$ of the wiping member 94 shown in FIG. 12A is the same as the moving direction A of the wiping member 70 shown in FIG. 3.

When the nozzle 280 is wiped, a part of the wiping sheet 92 is thrust into the tapered portion 280A of the nozzle 280. A biasing force, which is generated by the movement of the wiping member 94, acts on a downstream-side surface 280D of the tapered portion 280A of the nozzle 280 in the moving direction $A_1$ of the wiping member 94, so that the wiping sheet 92 is pressed against the downstream-side surface 280D.

On the other hand, since the wiping sheet 92, which is thrust into the tapered portion 280A of the nozzle 280, is separated from the upstream-side surface 280C of the tapered portion 280A of the nozzle 280 in the moving direction $A_1$ of the wiping member 94 due to the movement of the wiping member 94, it is thought that the adhering material 96 is likely to remain on the upstream-side surface 280C as shown in FIG. 12A.

When the adhering material 96 adheres to the tapered portion 280A or the like of the nozzle 280 as shown in FIG. 12B, the flight direction of a liquid droplet discharged from the nozzle 280 is bent. A liquid droplet 98B of which the flight direction is bent is discharged in a direction that is not perpendicular to the liquid discharge surface 30. The discharge direction of the liquid droplet 98B of which the flight direction is bent is indicated by an arrow.

A liquid droplet 98A, which is shown by a two-dot chain line and of which the flight direction is not bent, is discharged in a direction perpendicular to the liquid discharge surface 30.

Figure 13:
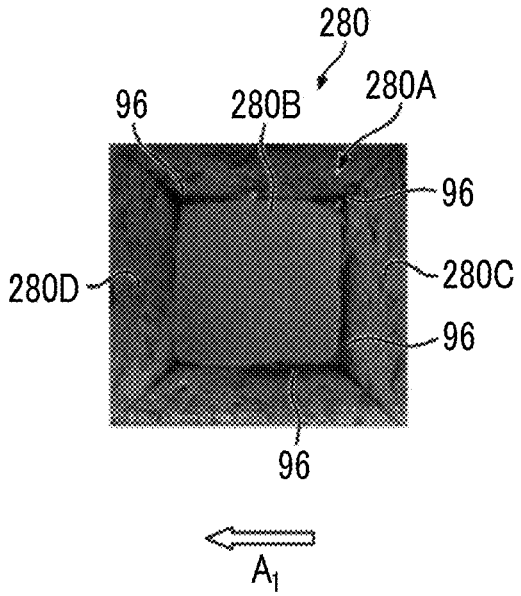
FIG. 13 is a view illustrating the internal state of the nozzle after the wiping processing using the wiping member that does not include raised irregularities on the wiping surface thereof.

FIG. 13 is a view illustrating the internal state of the nozzle after the wiping processing using the wiping member that does not include raised irregularities on the wiping surface thereof. FIG. 13 is an electron micrograph of the tapered portion 280A of the nozzle 280 that is enlarged and taken by an electron microscope.

As shown in FIG. 13, the adhering material 96 adheres to the upstream-side surface 280C of the tapered portion 280A of the nozzle 280 in the moving direction $A_1$ of the wiping member 94. On the other hand, the adhering material 96 remains on a part of the downstream-side surface 280D of the tapered portion 280A of the nozzle 280 in the moving direction $A_1$ of the wiping member 94, but the amount of the adhering material adhering to the downstream-side surface 280D is smaller than that of the adhering material adhering to the upstream-side surface 280C.

The nozzle 280 of which the planar shape of an opening 280B is a square shape has been shown in FIG. 13. However, since it is thought that the main factor of the remaining of the adhering material on the tapered portion 280A of the nozzle 280 is the influence of the contact pressure between the wiping member 94 and the liquid discharge surface 30, the moving speed of the wiping member 94, and the material of the wiping member 94, it is thought that the planar shape of the opening 280B of the nozzle 280 hardly affects the remaining of the adhering material.

Accordingly, it is thought that a state in which the adhering material remains in the nozzle 280 is the same even though the planar shape of the opening 280B of the nozzle 280 is the circular shape shown in FIG. 5 or the square shape shown in FIG. 13.

Figure 14A:
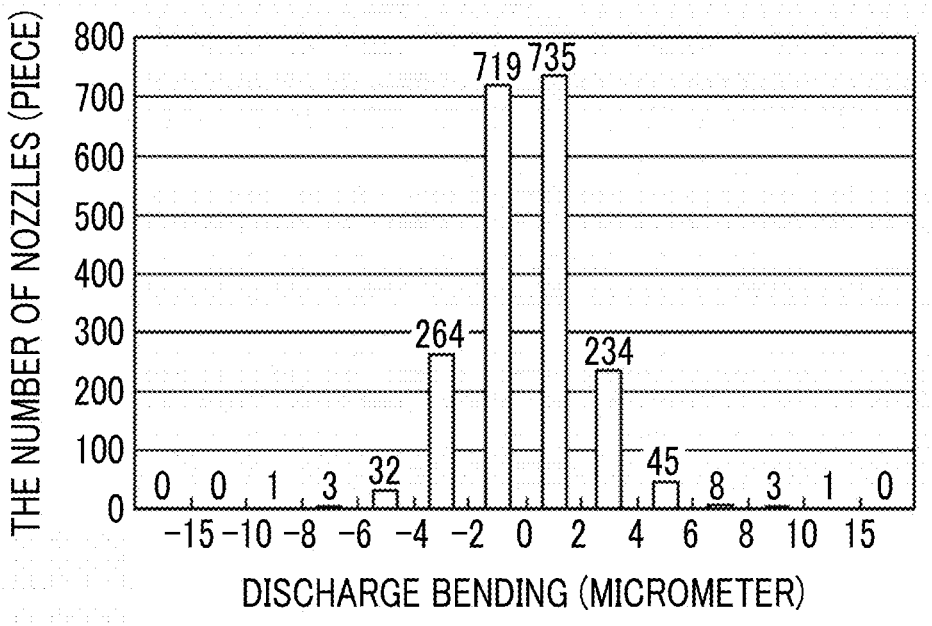
FIG. 14A is a view illustrating discharge performance before the wiping processing using the wiping member that does not include raised irregularities on the wiping surface thereof.
Figure 14B:
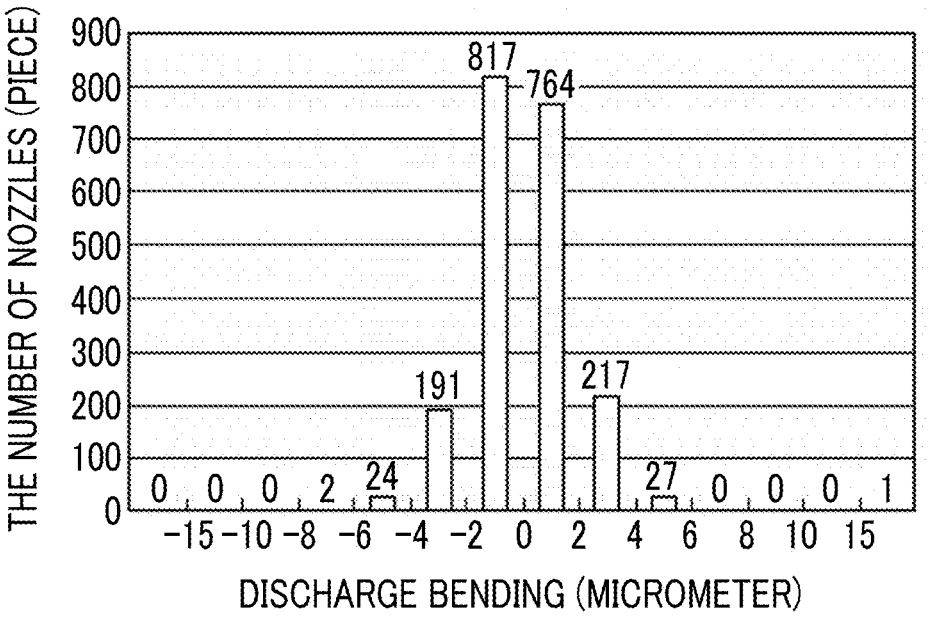
FIG. 14B is a view illustrating discharge performance after the wiping processing using the wiping member that does not include raised irregularities on the wiping surface thereof.

FIG. 14A is a view illustrating discharge performance before the wiping processing using the wiping member that does not include raised irregularities on the wiping surface thereof. FIG. 14B is a view illustrating discharge performance after the wiping processing using the wiping member that does not include raised irregularities on the wiping surface thereof.

The horizontal axes of FIGS. 14A and 14B represent discharge bending. The unit of the discharge bending is micrometer. The sign of discharge bending is defined as a positive sign on one side and a negative sign on the other side in the width direction X of the recording medium 12 shown in FIG. 4.

The vertical axes of FIGS. 14A and 14B represent the number of nozzles in which discharge bending occurs. The unit of the number of nozzles is a piece. Discharge bending is a state in which an error occurs between the landing position of a liquid droplet, which is discharged from the nozzle 280 shown in FIG. 5, on a recording medium and a theoretical landing position.

The measurement of discharge bending has been performed on the basis of the following measurement conditions by the following procedure.

<Measurement Conditions>

The liquid discharge head has a structure in which 2048 nozzles are arranged in the form of a matrix having 32 rows parallel to the X direction of FIG. 3 and 64 columns parallel to the Y direction. This also applies to the following measurement. An interval $P_{NY}$ between the nozzles in the lateral direction $Y_A$ of the liquid discharge head shown in FIG. 8 is 0.3 mm.

TORAYSEE manufactured by Toray Industries, Inc. was used as a wiping sheet corresponding to the wiping sheet 92 shown in FIG. 12A. TORAYSEE is a trade name of Toray Industries. Inc.

In the wiping processing, the wiping member was eccentrically rotated while the wiping surface to which a wiping sheet was attached comes into contact with the liquid discharge surface and a constant contact pressure, a constant rotational speed, a constant eccentric distance were maintained; and the wiping member was made to reciprocate while a constant moving speed was maintained in the longitudinal direction of the liquid discharge head over the entire length of the liquid discharge head in the longitudinal direction.

The wiping processing was manually and cautiously performed so that the contact pressure, the eccentrically rotational speed, the eccentric distance, and the moving speed of the wiping member in the longitudinal direction of the liquid discharge head were maintained constant. The contact pressure between the liquid discharge surface and the wiping surface, which is measured before the start of wiping, is 30 kPa.

An object of this measurement is to grasp a relative difference in a wiping effect depending on whether or not the raised irregularities of the wiping surface are thrust into the nozzle. Since it is thought that whether or not the raised irregularities of the wiping surface are thrust into the nozzle is mainly affected by the contact pressure between the liquid discharge surface and the wiping surface, the initial value of the contact pressure was measured.

If the eccentrically rotational speed, the eccentric distance, and the moving speed of the wiping member in the longitudinal direction of the liquid discharge head are constant, a difference in a wiping effect depending on whether or not the raised irregularities of the wiping surface are thrust into the nozzle can be arbitrarily verified even in a practical range.

<Measurement Procedure>

First, the wiping processing for the liquid discharge surface and the purge processing for the liquid discharge head are performed in an arbitrary state of the liquid discharge head. This state corresponds to the initial state of the liquid discharge head.

Next, discharge conditions where the state of the liquid discharge surface before wiping processing is obtained are set. Discharge conditions, such as discharge frequency and a discharge period, are set and the discharge operation of the liquid discharge head is performed.

The measurement of discharge bending is performed in this state as the state of the liquid discharge head that is not yet subjected to wiping processing. Data of the discharge bending is acquired as described below.

A test chart, which is formed of patterns having a constant interval in the width direction X of the recording medium 12 shown in FIG. 4, is printed. A test chart, which has one-ON and N-OFF patterns, can be applied as the test chart.

A distance between the patterns of the test chart is read. The data of discharge bending is calculated through the subtraction of a theoretical distance between the patterns from an actual distance between the patterns. The data of the discharge bending of all the nozzles are acquired.

Next, the wiping processing step S14 illustrated in FIG. 9 is performed on the liquid discharge head of which discharge bending has been measured before wiping processing. The discharge bending of the liquid discharge head, which has been subjected to the wiping processing, is measured in the same manner as the measurement of the discharge bending that is performed before wiping processing. The data of discharge bending of all the nozzles, which have been subjected to the wiping processing, are acquired.

The measurement of discharge bending was performed multiple times before and after the wiping processing in this way, and graphs shown in FIGS. 14A and 14B were made by using average values of the data of the discharge bending of the multiple times.

When the number of nozzles in which discharge bending occurs in FIG. 14A is compared with the number of nozzles in which discharge bending occurs in FIG. 14B, it can be said that a significant reduction in the number of nozzles in which discharge bending occurs is not seen regardless of the distance of discharge bending in a case in which wiping processing is performed by the wiping member that does not include raised irregularities on the wiping surface thereof.

A standard deviation of landing position errors, which are calculated from a relationship between discharge bending and the number of nozzles shown in FIG. 14A, is 1.9 μm and a standard deviation of landing position errors, which are calculated from a relationship between discharge bending and the number of nozzles shown in FIG. 14B, is 1.7 μm.

Even though the liquid discharge head is operated under certain discharge conditions, the state of the same liquid discharge surface is unlikely to be obtained. For this reason, a standard deviation of landing position errors was used for the comparison between discharge performance before wiping processing and discharge performance after wiping processing.

When a standard deviation of landing position errors before wiping processing is compared with a standard deviation of landing position errors after wiping processing, it can be said that the effective recovery of discharge performance after wiping processing is not seen. Considering that the liquid discharge head and the wiping sheet used in this measurement come under the category of a liquid discharge head and a wiping sheet to be generally used, the results of this measurement can be treated as the results of the same kind of measurement using a liquid discharge head and a wiping sheet. This also applies to the following measurement.

Figure 15:
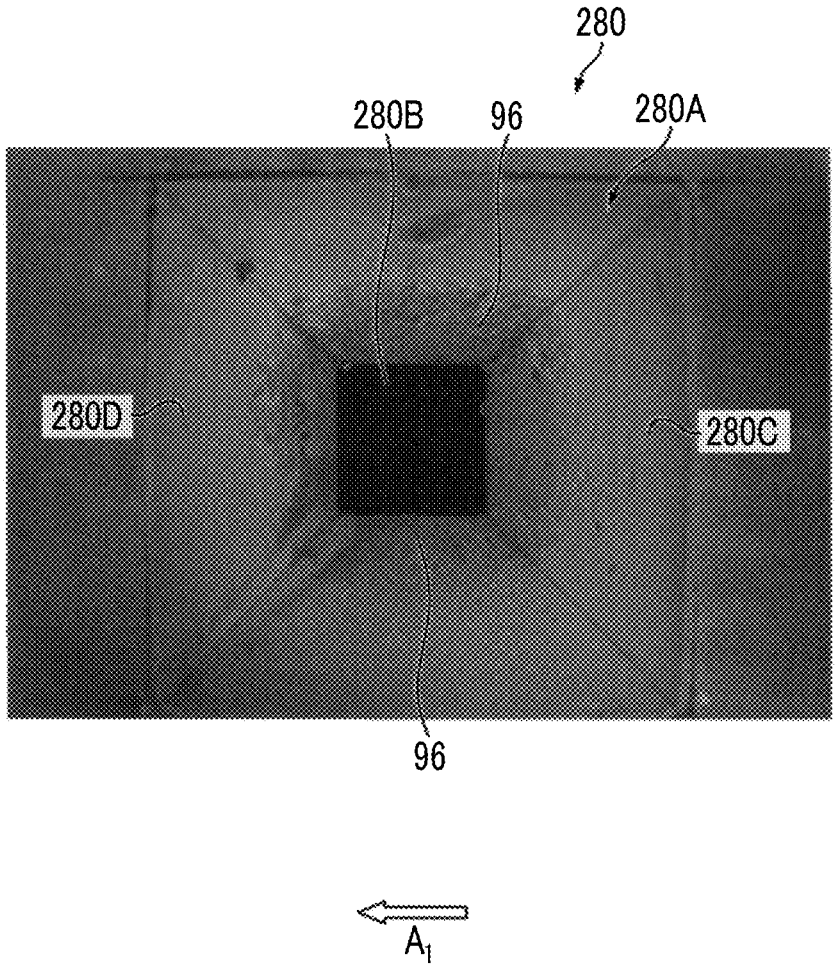
FIG. 15 is a view illustrating the internal state of the nozzle after the wiping processing using the wiping member that does not include raised irregularities on the wiping surface thereof.

FIG. 15 is a view illustrating the internal state of the nozzle after the wiping processing using the wiping member that does not include raised irregularities on the wiping surface thereof. FIG. 15 is an electron micrograph of the tapered portion 280A of the nozzle 280 shown in FIG. 7 that is enlarged and taken by an electron microscope.

Since an adhering material 96 remains around the opening 280B on the tapered portion 280A of the nozzle 280 as shown in FIG. 15, it is thought that discharge performance is little recovered.

It is thought that the adhering material 96 remains around the opening 280B as shown in FIG. 15 since the thrust of the wiping sheet 92 into the nozzle 280 is reduced due to a variation in the contact pressure between the wiping member 94 and the liquid discharge surface 30 shown in FIG. 12A, a variation in the surface nature of the wiping sheet 92, and a variation in the thickness of the wiping sheet 92.

Figure 16A:
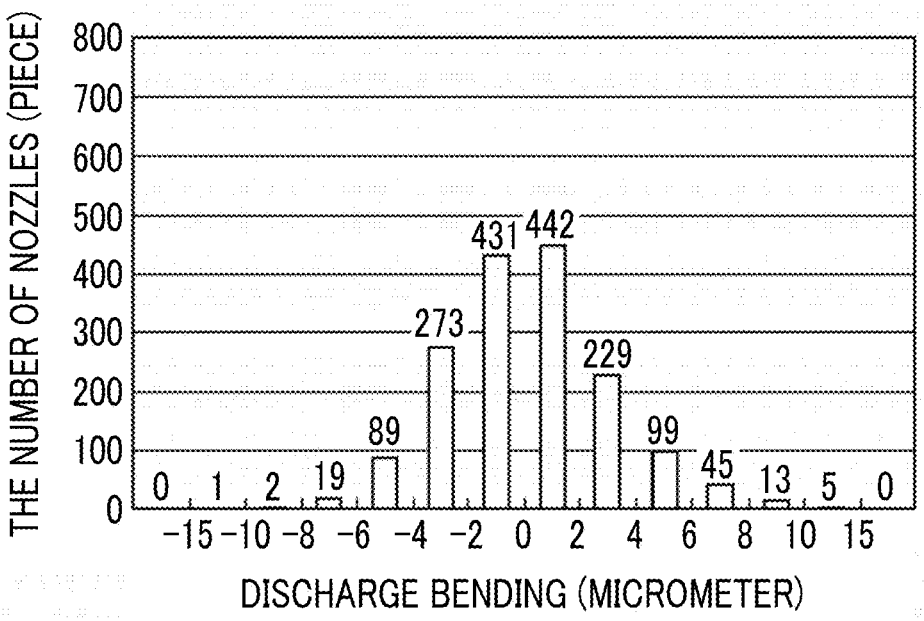
FIG. 16A is a view illustrating discharge performance before wiping processing using a wiping member that includes raised irregularities on the wiping surface thereof.
Figure 16B:
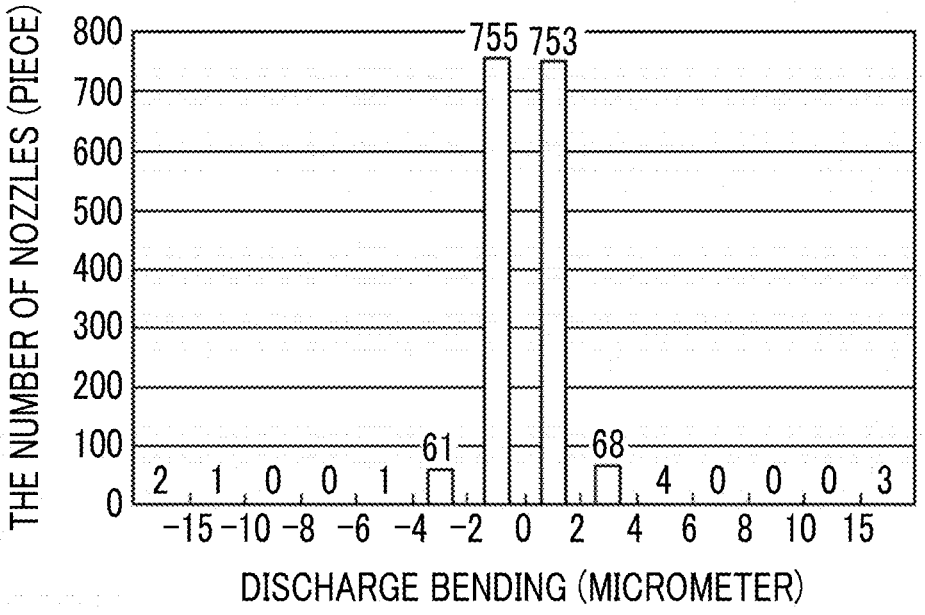
FIG. 16B is a view illustrating discharge performance after the wiping processing using the wiping member that includes raised irregularities on the wiping surface thereof.

FIG. 16A is a view illustrating discharge performance before the wiping processing using the wiping member that includes raised irregularities on the wiping surface thereof. FIG. 16B is a view illustrating discharge performance after the wiping processing using the wiping member that includes raised irregularities on the wiping surface thereof. Since the horizontal and vertical axes of FIGS. 16A and 16B are the same as those of FIGS. 14A and 14B, the description thereof will be omitted.

Since the measurement conditions and the measurement procedure of discharge bending are the same as those in the case in which a wiping member, which does not include raised irregularities on the lower wiping surface thereof, is used, the description thereof will be omitted. TX2066 manufactured by ITW Texwipe was used for the wiping surface. TX2066 is a trade name of ITW Texwipe.

As shown in FIGS. 16A and 16B, a significant reduction in the number of nozzles having a landing position error of which the absolute value is 2.0 μm or more is seen by the wiping processing using the wiping member that includes raised irregularities on the wiping surface thereof.

A standard deviation of landing position errors shown in FIG. 16A is 2.9 μm, and a standard deviation of landing position errors shown in FIG. 16B is 1.2 μm. The standard deviation of landing position errors after the wiping processing is significantly reduced in comparison with the standard deviation of landing position errors before the wiping processing.

Figure 17:
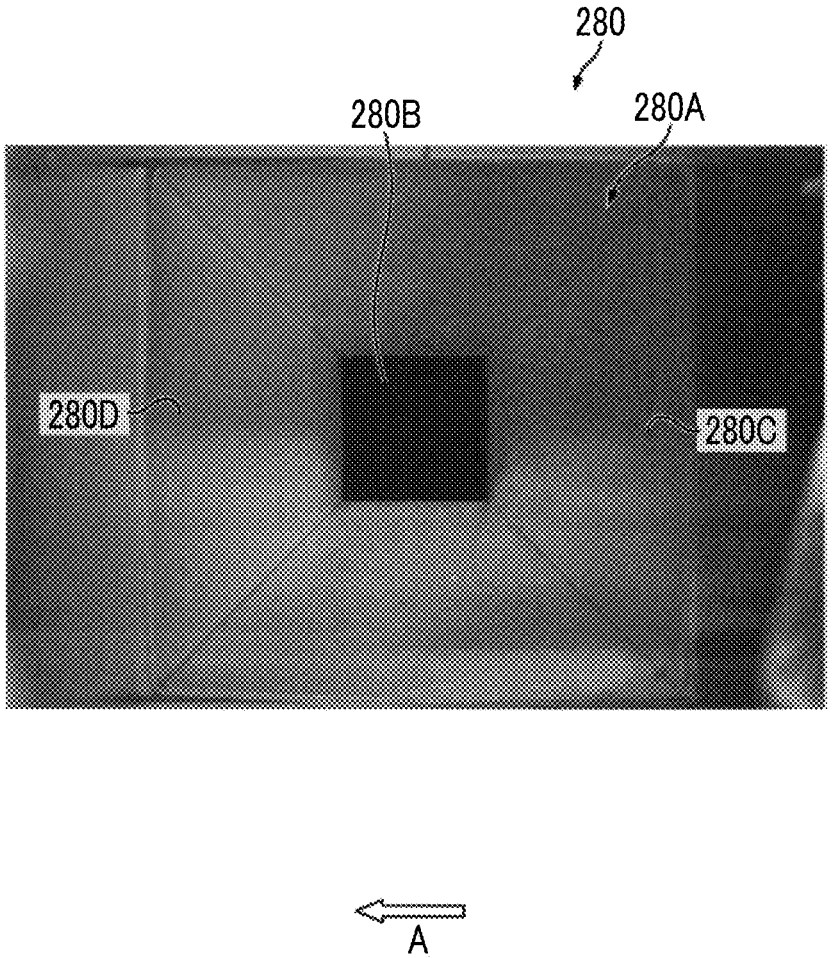
FIG. 17 is a view illustrating the internal state of the nozzle after the wiping processing using the wiping member that includes raised irregularities on the wiping surface thereof.

FIG. 17 is a view illustrating the internal state of the nozzle after the wiping processing using the wiping member that includes raised irregularities on the wiping surface thereof, and is an electron micrograph of the tapered portion 280A of the nozzle 280 shown in FIG. 7 that is enlarged and taken by an electron microscope.

As shown in FIG. 17, the adhesion of an adhering material is not seen on the tapered portion 280A of the nozzle 280 after the wiping processing using the wiping member that includes raised irregularities on the wiping surface thereof. Accordingly, an adhering material adhering to the inside of the nozzle 280 can be reliably removed by the wiping processing using the raised wiping member.

Accordingly, discharge performance can be recovered by the wiping processing using the wiping member that includes raised irregularities on the wiping surface thereof.

[Description of Operational Conditions for Method for Maintenance]

As shown in FIGS. 16A and 16B and FIG. 17, it was found that a high effect is obtained from the wiping processing using the wiping member 70, which is shown in FIG. 6 and includes raised irregularities on the wiping surface thereof, in comparison with the wiping processing using the wiping member 94 that is shown in FIG. 12 and does not include raised irregularities on the wiping surface thereof.

Next, the operational conditions, which are required for ensuring stable and high wiping effects, for a method for maintenance of a liquid discharge head will be described.

[Conditions of Eccentric Parameter]

Figure 18:
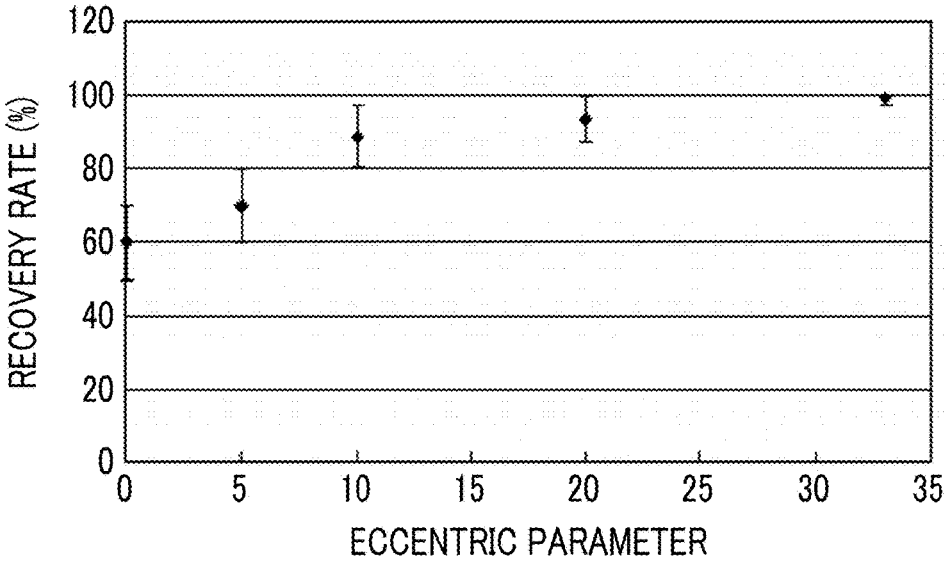
FIG. 18 is a graph showing a relationship between an eccentric parameter and the recovery rate of the discharge performance of the liquid discharge head.

FIG. 18 is a graph showing a relationship between an eccentric parameter and the recovery rate of the discharge performance of the liquid discharge head. The horizontal axis of FIG. 18 represents an eccentric parameter, and the vertical axis thereof represents a recovery rate. The recovery rate is expressed by a percentage.

The eccentric parameter is a value that represents a ratio relationship between the eccentric distance d shown in FIG. 6 and the interval $P_{NY}$ between the nozzles 280 in the lateral direction $Y_A$ of the liquid discharge head 16 shown in FIG. 8, and is expressed as a value $d/P_{NY}$ that is obtained by dividing the eccentric distance d shown in FIG. 6 by the interval $P_{NY}$ between the nozzles 280 in the lateral direction $Y_A$ of the liquid discharge head 16 shown in FIG. 8.

The recovery rate shown in FIG. 18 is expressed as "$\{(\sigma_1-\sigma_2)/(\sigma_1-\sigma_0)\}\times 100$" using a standard deviation $\sigma_0$ of landing position errors of the liquid discharge head in the initial state, a standard deviation $\sigma_1$ of landing position errors of the liquid discharge head not yet subjected to the wiping processing, and a standard deviation $\sigma_2$ of landing position errors of the liquid discharge head having been subjected to the wiping processing.

The liquid discharge head in the initial state may be a liquid discharge head that does not yet start to be used, and may be a used liquid discharge head that is subjected to certain maintenance processing and has discharge performance corresponding to the discharge performance of a liquid discharge head not yet starting to be used. That is, the liquid discharge head in the initial state has only to correspond to a state serving as a reference of discharge performance before and after the wiping processing.

The liquid discharge head, which has been subjected to the wiping processing, is a liquid discharge head which has been used under certain discharge conditions without being yet subjected to the wiping processing and on which the wiping processing of this embodiment is performed. That is, the recovery rate means a ratio of the discharge performance of the liquid discharge head, which has been subjected to the wiping processing, to the discharge performance of the liquid discharge head in the initial state that is set as 100%.

The following wiping processing conditions were applied to the wiping processing.

<Wiping Processing Conditions>

Contact pressure between wiping member and liquid discharge surface: 23.4 kPa

The number of times of wiping: the wiping member is made to reciprocate over the entire length of the liquid discharge head in the longitudinal direction to perform the wiping of a forward path one time and the wiping of a backward path one time Moving speed of wiping member: 5 mm per second Eccentrically rotational speed of wiping member: 150 revolutions per hour Interval between nozzles in the direction orthogonal to moving direction of wiping member: 0.3 mm Eccentric distance: five kinds of values of 0 mm, 1.5 mm, 3.0 mm, 6.0 mm, and 10 mm are applied Eccentric parameter: five kinds of values of 0, 5, 10, 20, and 33 are applied Direction of center of eccentric rotation from center of noneccentric rotation serving as reference: a direction orthogonal to the moving direction of the wiping member The measurement procedure is as follows.

<Measurement Procedure>

First, a liquid discharge head in the initial state or a liquid discharge head, which has discharge performance corresponding to the discharge performance of the liquid discharge head in the initial state, is used to measure the landing position error of each nozzle and to calculate $\pm 3\sigma$ values and a standard deviation Go of landing position errors of the liquid discharge head in the initial state.

Since the measurement of the landing position errors is the same as described above, the description thereof will be omitted here. This also applies to the following description.

Next, after the liquid discharge head is operated under discharge conditions that are determined in advance, the landing position error of each nozzle is measured and $\pm 3\sigma$ values and the standard deviation $\sigma_1$ of the landing position errors of the liquid discharge head immediately before the wiping processing are calculated.

In addition, a liquid discharge head, which has been subjected to maintenance processing under the above-mentioned conditions, is used to measure the landing position error of each nozzle and to calculate $\pm 3\sigma$ values and a standard deviation $\sigma_2$ of landing position errors of the liquid discharge head that has been subjected to wiping processing.

While an eccentric parameter is changed, the above-mentioned measurement is performed for a plurality of kinds of eccentric parameters.

The range of the recovery rate of FIG. 18 is a $3\sigma$ range that is calculated using the value of the standard deviation, and represents a variation in a recovery rate. In a case in which an eccentric parameter is 10, a standard deviation 88.3% and the range of a variation in a recovery rate is 16.7%.

In a case in which an eccentric parameter is 20, a standard deviation is 93.3 and the range of a variation in a recovery rate is 12.5%. In a case in which an eccentric parameter is 33, a standard deviation is 98.3 and the range of a variation in a recovery rate is 2.5%.

That is, it was found that a recovery rate is improved and a variation in a recovery rate is reduced when an eccentric parameter is increased.

When the condition of a recovery rate required for achieving certain image quality is specified as 80% or more, an eccentric parameter is 10 or more. Further, when the condition of a recovery rate is specified as 90%, an eccentric parameter is 20 or more. Furthermore, considering a variation in a recovery rate, it is preferable that an eccentric parameter is set to 33 or more.

That is, when a condition of "an eccentric parameter is 10 or more" is employed as the wiping condition of the wiping member 70 shown in FIG. 6 in the wiping processing step S14 illustrated in FIG. 9, certain discharge performance of the liquid discharge head having been subjected to the maintenance processing is ensured. In this case, certain image quality is ensured in the formation of an image using a liquid discharge head.

The upper limit of an eccentric parameter is determined from a condition that allows the wiping member to be stably and eccentrically rotated. For example, the upper limit of an eccentric parameter is determined from conditions, such as the size and the eccentrically rotational speed of the wiping member, the moving speed of the wiping member, and whether or not the run-out of the wiping member occurs.

In a case in which the upper limit of an eccentric parameter is specified from the size of the wiping surface of the wiping member, an eccentric parameter is equal to or smaller than a value where an eccentric distance is obtained as a value smaller than a half of the maximum length of the wiping surface.

In this embodiment, the direction of the center of eccentric rotation from the center of noneccentric rotation serving as a reference has been a direction orthogonal to the moving direction of the wiping member. However, considering that an object of the eccentric rotation of the wiping surface is to wipe the nozzle in multiple directions, an arbitrary direction can be applied as the direction of the center of eccentric rotation from the center of noneccentric rotation serving as a reference.

[Conditions of Internal Pressure of Liquid Discharge Head]

As described above, a high effect is obtained from the wiping processing for the liquid discharge head using the wiping member, which includes raised irregularities on the wiping surface thereof, in comparison with a case in which the wiping member not including raised irregularities on the wiping surface thereof is used.

The generation of an abnormal nozzle in which a flight direction changes causes a problem in the wiping processing for the liquid discharge head using the wiping member, which includes raised irregularities on the wiping surface thereof, in comparison with a case in which the wiping member not including raised irregularities on the wiping surface thereof is used.

When FIGS. 16A and 16B are compared with each other, a nozzle of which the absolute value of discharge bending is 15 μm or more is not present in FIG. 16A but a nozzle of which the absolute value of discharge bending is 15 μm or more is present in FIG. 16B.

For this reason, an operational condition of maintenance processing, which suppresses the generation of an abnormal nozzle to substantially the same level as a case in which the wiping member not including raised irregularities on the wiping surface thereof is used, is necessary. It is thought that the cause of the generation of an abnormal nozzle in a case in which the wiping member including raised irregularities on the wiping surface thereof is used is the trapping of bubbles, which are present between pieces of raised yarn, in the nozzle.

Accordingly, the condition of nozzle surface pressure at the time of the wiping processing is set as the operational condition of maintenance processing so that it is difficult for bubbles to be trapped in the nozzle. The nozzle surface pressure at the time of the wiping processing is managed by the internal pressure of the liquid discharge head.

That is, it is possible to make nozzle surface pressure be in a certain range within the range of a variation of each nozzle by making the internal pressure of the liquid discharge head constant.

The internal pressure of the liquid discharge head 16 is adjusted by the pump 86 shown in FIG. 3. That is, the set value of the internal pressure of the liquid discharge head 16 is the set value of the pump 86, and it is possible to switch the set value of the internal pressure of the liquid discharge head 16 at the time of drawing based on image data, which is liquid discharge based on input discharge data, and the set value of the internal pressure of the liquid discharge head 16 at the time of wiping processing by switching the set value of the pump 86.

Figure 19:
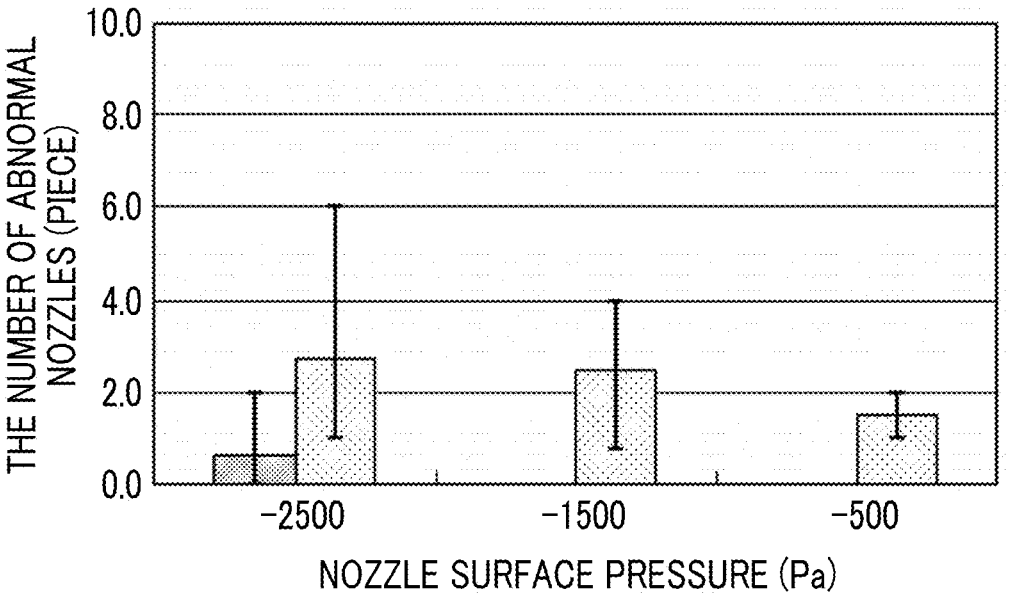
FIG. 19 is a view illustrating a relationship between nozzle surface pressure at the time of wiping processing and the number of abnormal nozzles.

FIG. 19 is a view illustrating a relationship between nozzle surface pressure at the time of wiping processing and the number of abnormal nozzles. The horizontal axis of FIG. 19 represents nozzle surface pressure, and the unit of the nozzle surface pressure is Pascal. The vertical axis of FIG. 19 represents the number of abnormal nozzles, and the unit of the number of abnormal nozzles is a piece.

The nozzle surface pressure shown in FIG. 19 is the set value of the internal pressure of the liquid discharge head 16 shown in FIG. 3. In the following description, the nozzle surface pressure shown in FIG. 19 is described as the set value of the internal pressure of the liquid discharge head 16 shown in FIG. 3. Conditions of the wiping processing in the measurement of the number of abnormal nozzles shown in FIG. 19 are as follows.

<Wiping Processing Conditions>

Contact pressure between wiping member and liquid discharge surface: 23.4 kPa

The number of times of wiping: the wiping member is made to reciprocate over the entire length of the liquid discharge head in the longitudinal direction to perform the wiping of a forward path one time and the wiping of a backward path one time Moving speed of liquid discharge head: 5 mm per second Rotational speed of wiping member: 150 revolutions per hour Interval between nozzles in the direction orthogonal to moving direction of wiping member: 0.3 mm Eccentric distance: 10.0 mm Eccentric parameter: 33

Direction of center of eccentric rotation from center of noneccentric rotation serving as reference: a direction orthogonal to the moving direction of the wiping member The eccentric parameter was rounded to one decimal place.

The measurement procedure is as follows.

<Measurement Procedure>

First, a liquid discharge head in the initial state or a liquid discharge head, which has discharge performance corresponding to the discharge performance of the liquid discharge head in the initial state, is operated under discharge conditions that are determined in advance.

After that, the liquid discharge head, which has been subjected to wiping processing under the above-mentioned conditions, is used to measure the landing position error of each nozzle and to measure the number of abnormal nozzles after the wiping processing. A nozzle having a landing position error of 13.0 μm or more is determined as an abnormal nozzle.

While the set value of the internal pressure of the liquid discharge head 16 shown in FIG. 3 is changed, the above-mentioned measurement is performed for three set values of −2500 Pa, −1500 Pa, and −500 Pa.

The above-mentioned measurement was performed multiple times; and the maximum values, the minimum values, and the average values of the number of abnormal nozzles, which are newly generated, were calculated. In the graph illustrated in FIG. 19, the average values of the number of abnormal nozzles, which were newly generated, were represented by bar graphs and the maximum values, the minimum values, and the ranges of the maximum values were shown so as to overlap the bar graphs representing the average values. The number of the abnormal nozzles, which are newly generated, are the number of abnormal nozzles after the wiping processing.

In a case in which the set value of the internal pressure of the liquid discharge head 16 shown in FIG. 3 is −2500 Pa, the number of the abnormal nozzles, which is shown on the right side in FIG. 19, means the number of abnormal nozzles after the wiping processing using the wiping member that includes raised irregularities on the wiping surface thereof.

In a case in which the set value of the internal pressure of the liquid discharge head 16 shown in FIG. 3 is −2500 Pa, the number of the abnormal nozzles, which is shown on the left side, is the number of abnormal nozzles after the wiping processing using the wiping member that does not include raised irregularities on the wiping surface thereof.

A value obtained by subtracting the number of abnormal nozzles after the wiping processing using the wiping member, which does not include raised irregularities on the wiping surface thereof, from the number of abnormal nozzles after the wiping processing using the wiping member, which includes raised irregularities on the wiping surface thereof, is the number of abnormal nozzles that are newly generated after the wiping processing using the wiping member that includes raised irregularities on the wiping surface thereof.

When the set value of the internal pressure of the liquid discharge head 16 shown in FIG. 3 is further increased, the generation of new abnormal nozzles after the wiping processing using the wiping member, which includes raised irregularities on the wiping surface thereof, can be suppressed as shown in FIG. 19.

If the number of abnormal nozzles, which are newly generated, is in an allowable range even though the set value of the internal pressure of the liquid discharge head 16 is −2500 Pa, −2500 Pa can be applied as the condition of nozzle surface pressure at the time of the wiping processing.

−2500 Pa can be applied as the set value of the internal pressure of the liquid discharge head 16 of FIG. 3 at the time of liquid discharge that is performed on the basis of input discharge data. Further, −2500 Pa can be applied as the set value of the internal pressure of the liquid discharge head 16 when liquid present in the liquid discharge head is circulated through a circulation flow passage. The set value of the internal pressure of the liquid discharge head 16 at the time of the wiping processing can be equal to or larger than the set value of the internal pressure of the liquid discharge head 16 at the time of liquid discharge that is performed on the basis of input data, or can be equal to or larger than the set value of the internal pressure of the liquid discharge head 16 when liquid present in the liquid discharge head is circulated through the circulation flow passage.

That is, the set value of the pump 86 is appropriately changed according to the structure of the liquid discharge head, liquid to be used, the environment of the apparatus, and the like. Accordingly, since the set value of the pump 86 at the time of liquid discharge, which is performed on the basis of input data, serves as a reference, nozzle surface pressure based on the set value of the pump 86 at the time of preferred wiping processing can be set even in the cases of any structure of the liquid discharge head, any liquid to be used, and any environment of the apparatus.

[Conditions of Purge Period]

Figure 20:
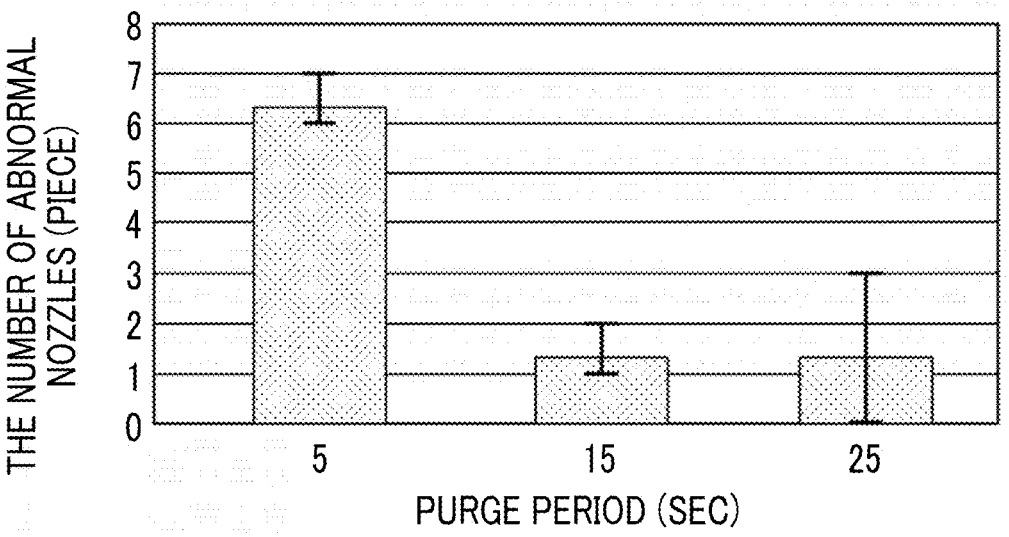
FIG. 20 is a view illustrating a relationship between a purge period and the number of abnormal nozzles.

FIG. 20 is a view illustrating a relationship between a purge period and the number of abnormal nozzles. Since maintenance conditions in the measurement of the number of abnormal nozzles shown in FIG. 20 are the same as maintenance conditions in the measurement of the number of abnormal nozzles shown in FIG. 19, the description thereof will be omitted here.

The measurement procedure is as follows.

<Measurement Procedure>

First, a liquid discharge head in the initial state or a liquid discharge head, which has discharge performance corresponding to the discharge performance of the liquid discharge head in the initial state, is operated under discharge conditions that are determined in advance.

After that, the liquid discharge head, which has been subjected to wiping processing under the above-mentioned conditions and has been subjected to post-wiping processing purge processing after the wiping processing, is used to measure the landing position error of each nozzle and to measure the number of abnormal nozzles after the wiping processing.

While a purge period is changed, the measurement of the number of abnormal nozzles after the wiping processing is performed in three kinds of purge periods of 5 sec, 15 sec, and 25 sec.

The measurement of the number of abnormal nozzles after the wiping processing is performed multiple times in each of the purge periods. The maximum value, the minimum value, and the average value of the number of abnormal nozzles are calculated in each of the purge periods. In the graph illustrated in FIG. 20, the average values of the number of abnormal nozzles were represented by bar graphs, and the maximum values and the minimum values of the number of abnormal nozzles and the ranges of the maximum values were shown so as to overlap the bar graphs representing the average values.

When a case in which a purge period is 5 sec is compared with a case in which a purge period is 15 sec, a reduction in the number of abnormal nozzles is seen in the case in which a purge period is 15 sec. On the other hand, when a case in which a purge period is 15 sec is compared with a case in which a purge period is 25 sec, a reduction in the number of abnormal nozzles is not seen.

Here, the purge period of the standard purge processing for the liquid discharge head, which is used in the above-mentioned measurement, can be set to 5 sec. In other words, when purge processing is performed on the liquid discharge head, which is used in the above-mentioned measurement, for 5 sec, certain effects of purge processing can be obtained.

Further, when the purge period of the post-wiping processing purge processing, which is performed after the wiping processing, is set to three or more times the standard purge period of the standard purge processing, bubbles trapped in the nozzle at the time of the wiping processing can be more reliably discharged. Accordingly, the stable recovery of discharge performance is realized.

Furthermore, when the period of the post-wiping processing purge processing is set to five or less times the standard purge period, bubbles trapped in the nozzle at the time of the wiping processing can be discharged while the consumption of liquid in the purge processing is suppressed.

From the viewpoint of conditions, such as the structure of the liquid discharge head, the type of liquid to be used, and the environment of the apparatus, and the suppression of the consumption of liquid in the purge processing, the standard purge period in which certain effective effects are obtained is determined. Since the purge period of the post-wiping processing purge processing is set to three to five times the standard purge period, a preferred purge period of the post-wiping processing purge processing can be set regardless of the structure of the liquid discharge head, liquid to be used, and the environment of the apparatus.

[Conditions of Eccentrically Rotational Speed and Moving Speed of Wiping Member]

When the eccentrically rotational speed of the wiping member 70 shown in FIG. 8 is further reduced, the number of times of contact between the wiping surface 70D and the liquid discharge surface 30 is increased and a period in which the wiping surface 70D and the liquid discharge surface 30 are in contact with each other is lengthened. Accordingly, a higher wiping effect can be obtained.

When the moving speed of the wiping member 70 is further reduced, the same effect as the effect, which is obtained when the eccentrically rotational speed of the wiping member 70 is further reduced, can be obtained.

However, since a period required for the wiping processing is lengthened when the moving speed of the wiping member 70 is further reduced, the moving speed of the wiping member 70 is determined in consideration of the conditions of a period required for the wiping processing.

It is preferable that a plurality of set values are prepared in advance and the set values of the eccentrically rotational speed of the wiping member 70 and the moving speed of the wiping member 70 are appropriately switched in accordance with the state of the liquid discharge surface 30, or the like.

Modification Examples

Next, modification examples of this embodiment will be described.

First Modification Example of Wiping Processing

Figure 21A:
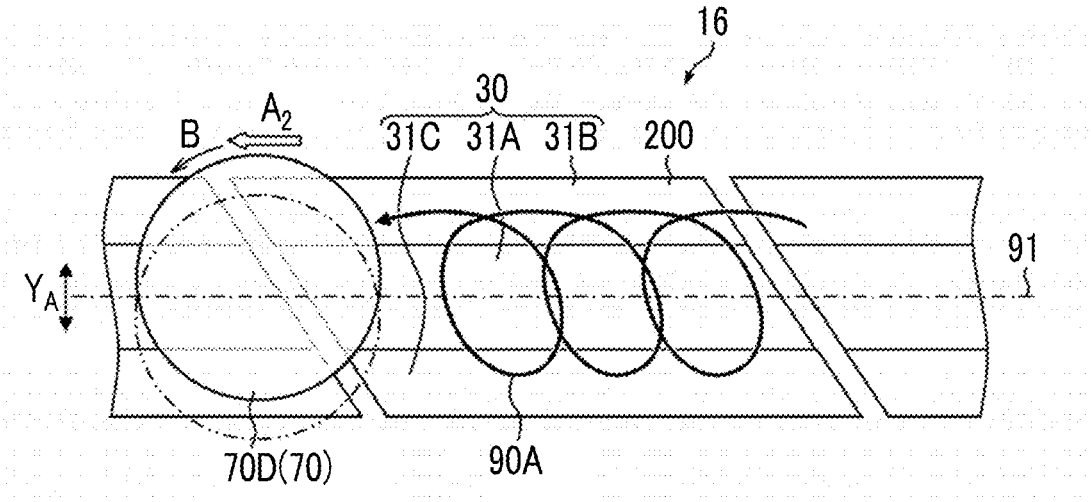
FIG. 21A is a view illustrating wiping processing for a forward path according to a first modification example.
Figure 21B:
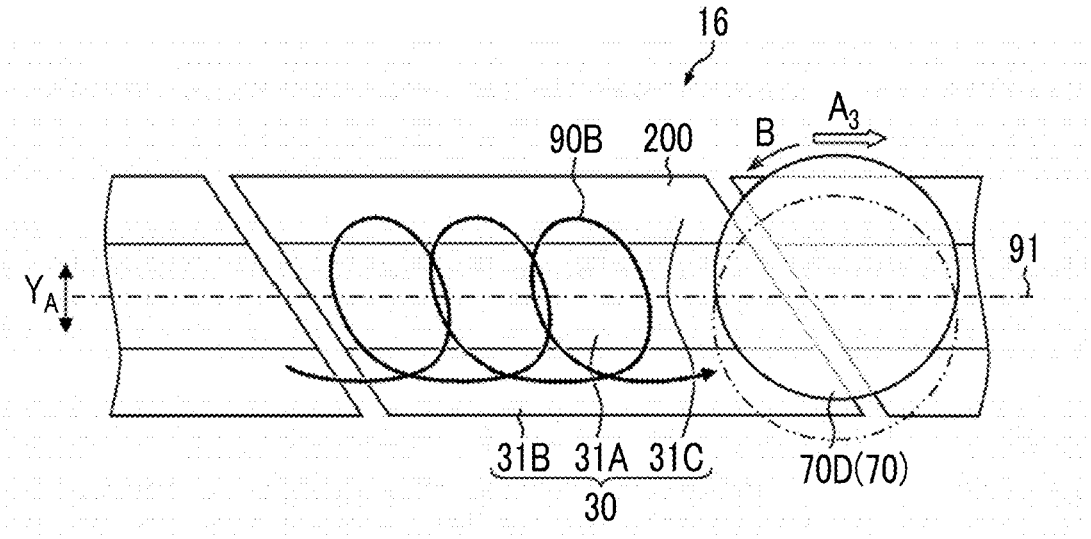
FIG. 21B is a view illustrating wiping processing for a backward path according to the first modification example.

FIG. 21A is a view illustrating wiping processing for a forward path according to a first modification example. Further, FIG. 21B is a view illustrating wiping processing for a backward path according to the first modification example. Only a part of the liquid discharge head 16 and only a part of a wiping member 70 are shown in FIGS. 21A and 21B.

In the wiping processing shown in FIGS. 21A and 21B, the wiping member 70 is made to reciprocate over the entire length of the liquid discharge head 16 in the longitudinal direction of the liquid discharge head 16 to wipe the entire liquid discharge surface 30 two times.

Since the number of times of contact between the wiping member 70 and the liquid discharge surface 30, the nozzles 280 shown in FIG. 5, and the inside of the nozzles 280 is further increased in the wiping processing shown in FIGS. 21A and 21B, adhering materials present on the liquid discharge surface 30, the nozzles 280, and on the inside of the nozzles 280 are more reliably removed.

Reference numeral 90A shown in FIG. 21A denotes a trajectory that is drawn on the liquid discharge surface 30 by an arbitrary point of the wiping member 70 in the wiping processing for a forward path. Further, reference letter $A_2$ denotes the moving direction of the wiping member 70 on the forward path, and this moving direction is an aspect of a first direction.

Reference numeral 90B shown in FIG. 21B denotes a trajectory that is drawn on the liquid discharge surface 30 by an arbitrary point of the wiping member 70 in the wiping processing for a backward path. Further, reference letter $A_3$ denotes the moving direction of the wiping member 70 on the backward path, and this moving direction is an aspect of the first direction.

When the eccentric rotation direction of the wiping member 70 on the backward path is reversed to be opposite to the eccentric rotation direction thereof on the backward path, the wiping member 70 comes into contact with the nozzles 280 shown in FIG. 5 in more directions. Accordingly, the nozzles 280 and the inside of the nozzles 280 can be wiped thoroughly. As a result, the improvement of the effects of the wiping processing is expected.

Second Modification Example

Figure 22A:
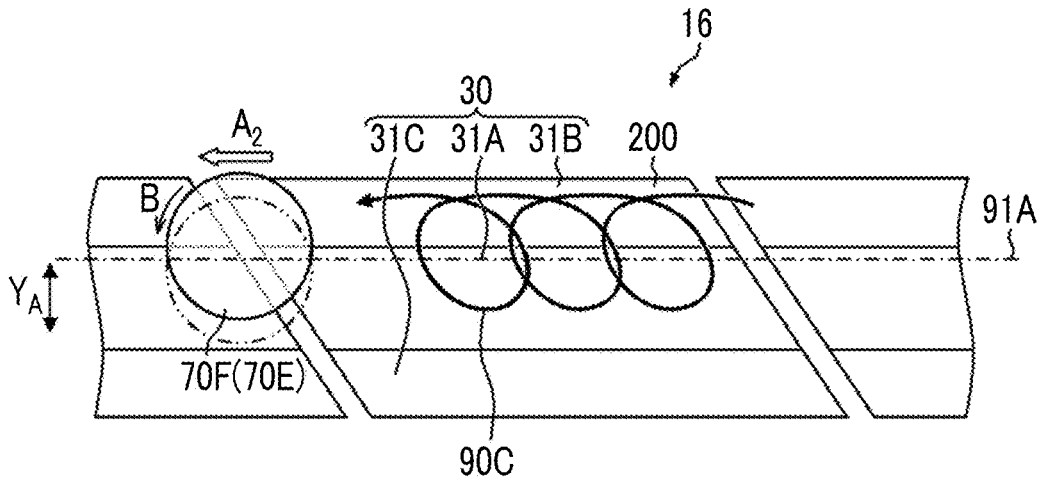
FIG. 22A is a view illustrating wiping processing for a forward path according to a second modification example.
Figure 22B:
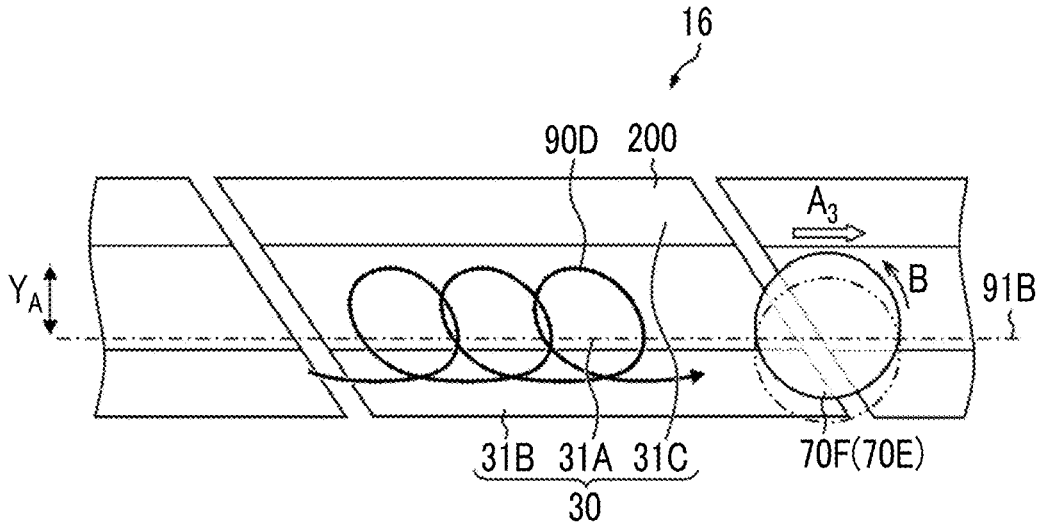
FIG. 22B is a view illustrating wiping processing for a backward path according to the second modification example.

FIG. 22A is a view illustrating wiping processing for a forward path according to a second modification example. FIG. 22B is a view illustrating wiping processing for a backward path according to the second modification example.

In the wiping processing shown in FIGS. 22A and 22B, a wiping member 70E, which has a diameter or a total length shorter than the entire length of the liquid discharge head 16 in a lateral direction $Y_A$, is used and the wiping member 70E is made to reciprocate at least one time over the entire length of the liquid discharge head 16 in the longitudinal direction of the liquid discharge head 16 to wipe the entire liquid discharge surface 30 one times.

In the wiping processing shown in FIGS. 22A and 22B, the wiping member 70E is made smaller than the wiping member 70 shown in FIG. 8 and the like and the effects of the wiping processing are maintained. Reference numeral 90C shown in FIG. 22A denotes the trajectory of an arbitrary point on a wiping surface 70F of the wiping member 70E. Reference numeral 91A denotes a trajectory along which the center of eccentric rotation of the wiping surface 70F of the wiping member 70E passes through the forward path.

Reference numeral 90D shown in FIG. 22B denotes the trajectory of an arbitrary point on the wiping surface 70F of the wiping member 70E. Reference numeral 91B denotes a trajectory along which the center of eccentric rotation of the wiping surface 70F of the wiping member 70E passes through the backward path.

An eccentrically rotational speed in the wiping processing for the forward path shown in FIG. 22A, an eccentrically rotational speed in the wiping processing for the backward path shown in FIG. 22B, and the moving speed of the wiping member 70E may be appropriately changed.

An aspect in which the wiping member is moved one time over the entire length of the liquid discharge head in the longitudinal direction, and an aspect in which the wiping member is made to reciprocate one by one over the entire length of the liquid discharge head in the longitudinal direction have been exemplified in this embodiment, but the number of times of wiping can also be further increased. The post-wiping processing purge processing may be performed after at least the last wiping processing.

In the liquid discharge head including the plurality of head modules 200 shown in FIG. 4, the wiping processing and the post-wiping processing purge processing can also be performed for each of the head modules 200. Further, the number of times of wiping processing for the head modules 200 may vary.

For example, the frequency of use of each head module 200 may be stored and the number of times of wiping processing for the head modules 200 having high frequency of use can also be increased.

Modification Example of Raised Wiping Surface

FIGS. 23 to 27 are views illustrating modification examples of the wiping member that includes raised irregularities on the wiping surface thereof. The same components of FIGS. 23 to 27 as those of FIG. 7 are denoted by the same reference numerals as those of FIG. 7, and the description thereof will be appropriately omitted.

Figure 23:
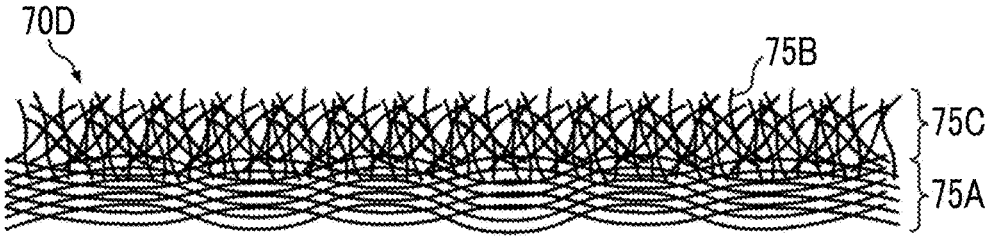
FIG. 23 is a view illustrating a modification example of the wiping member that includes raised irregularities on the wiping surface thereof.
Figure 24:
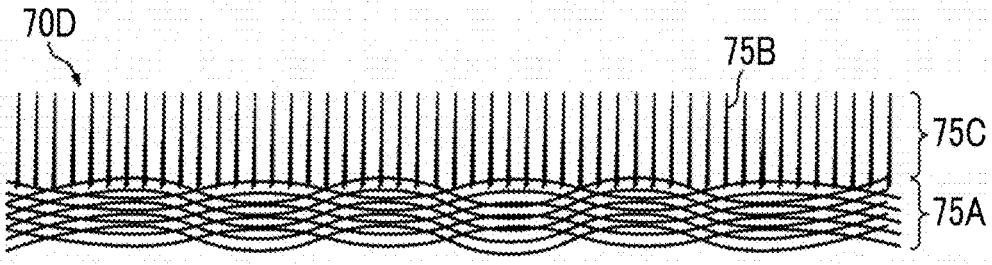
FIG. 24 is a view illustrating a modification example of the wiping member that includes raised irregularities on the wiping surface thereof.

Raised yarn 75B may be arranged so as to be randomly directed in various directions as shown in FIG. 23, and raised yarn 75B may be arranged so as to stand in a directed substantially perpendicular to a ground texture portion 75A as shown in FIG. 24. Further, as shown in FIG. 7, raised yarn 75B may lie down in a direction opposite to a wiping direction.

In all the aspects, the raised yarn 75B is easily thrust into the nozzles 280 at the time of the wiping processing. Accordingly, the inside of the nozzles 280 can be more effectively wiped. Further, dirt adhering to the liquid discharge surface 30 can also be more efficiently scraped off.

Figure 25:
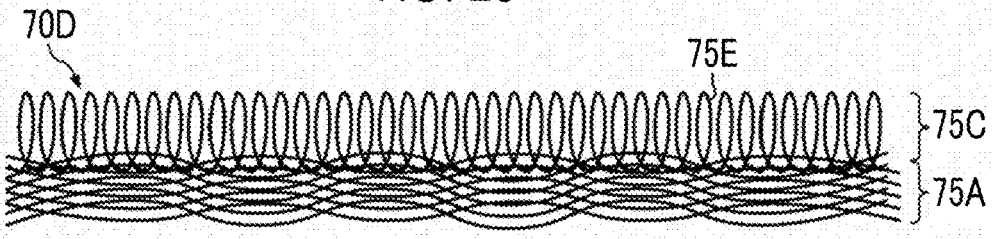
FIG. 25 is a view illustrating a modification example of the wiping member that includes raised irregularities on the wiping surface thereof.

As shown in FIG. 24, brush-like raised yarn 75B may be implanted in a wiping surface 70D. As shown in FIG. 25, a wiping surface 70D may be formed of so-called pile fabric in which raised yarn 75E may stand in the form of a loop or a string.

Figure 26:
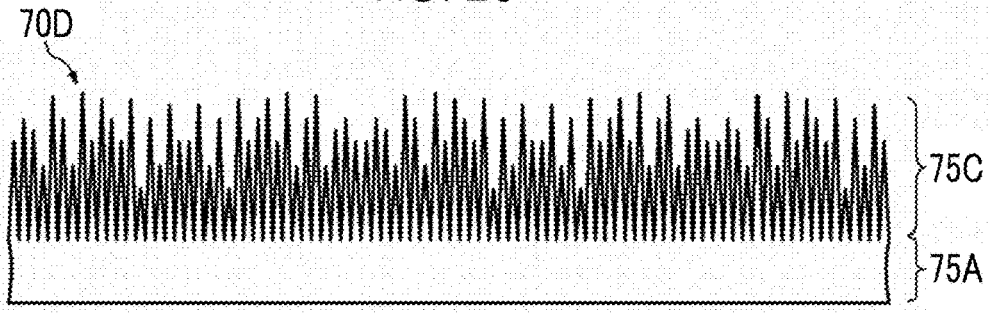
FIG. 26 is a view illustrating a modification example of the wiping member that includes raised irregularities on the wiping surface thereof.

Even though the surface roughness of a wiping surface 70D may be increased as shown in FIG. 26, the same effects can be obtained. In this case, the surface roughness of the wiping surface 70D is appropriately selected according to the size, the shape, and the like of the opening of each of the nozzles 280 that are formed on the liquid discharge surface 30 serving as an object to be wiped.

Figure 27:
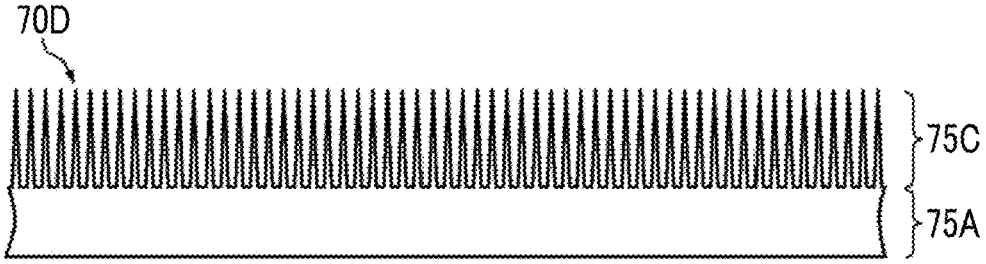
FIG. 27 is a view illustrating a modification example of the wiping member that includes raised irregularities on the wiping surface thereof.

Further, a ground texture portion 75A of the wiping surface 70D does not necessarily need to be knitting or woven fabric and may be formed of a sheet made of rubber. That is, as shown in FIG. 27, raised irregularities may be integrally formed on the surface of a sheet made of rubber.

A sheet-like wiping member including the raised irregularities shown in FIG. 7 and FIGS. 23 to 27 may be attached to the wiping surface 70D to form the wiping surface 70D including the raised irregularities.

[Functional Effects]

According to the method for maintenance of a liquid discharge head and the liquid discharge apparatus, which are formed as described above, the nozzles 280 can be wiped in multiple directions since the wiping surface 70D is eccentrically rotated.

Further, since the wiping surface 70D including raised yarn 75B, which is raised irregularities, is used, the adhering materials 96 present in the nozzles 280 can be removed by the raised yarn 75B that is thrust into the nozzles 280.

Furthermore, since the purge processing is performed after the wiping processing, bubbles present in the nozzles can be discharged.

Accordingly, it is possible to lengthen the life of the liquid discharge head 16 by recovering the discharge performance of the liquid discharge head 16 of which the discharge state has deteriorated due to the deterioration of discharge performance.

Since the internal pressure of the liquid discharge head 16 is set to be equal to or higher than internal pressure at the time of liquid discharge performed on the basis of discharge data, the trapping of bubbles in the nozzles 280 at the time of the wiping processing, which uses the wiping surface 70D including the raised yarn 75B, is suppressed Since the purge period of the post-wiping processing purge processing is set to three to five times the purge period of standard purge processing, the consumption of liquid is suppressed while bubbles trapped in the nozzles 280 are discharged by the post-wiping processing purge processing even though bubbles are trapped in the nozzles 280 when wiping processing using the wiping surface 70D including the raised yarn 75B is performed.

When an eccentric parameter expressed as $d/P_{NY}$, which denotes a value obtained by dividing the eccentric distance d by the interval $P_{NY}$ between the nozzles in the lateral direction $Y_A$ of the liquid discharge head 16, is set to 20 or more and the wiping member is eccentrically rotated, the recovery state of the discharge performance of the liquid discharge head can be made to be a higher recovery state.

In addition, when an eccentric parameter is set to 33 or more, a variation in the recovery state of the discharge performance of the liquid discharge head is suppressed. Accordingly, the recovery state of the discharge performance of the liquid discharge head can be stably made to be a high recovery state.

The method for maintenance of a liquid discharge head and the liquid discharge apparatus, which have been described above, may be appropriately subjected to modification, addition, and removal without departing from the scope of the invention. Further, the above-mentioned embodiments may be appropriately combined.

EXPLANATION OF REFERENCES

10: liquid discharge apparatus
16, 16C, 16M, 16Y, 16K: liquid discharge head
30, 30C, 30M, 30Y, 30K: liquid discharge surface
40: maintenance processing section
42: wiping processing unit
44: purge processing unit
70, 70E: wiping member
70C: center of eccentric rotation
70D: wiping surface
75B: raised yarn
280: nozzle

What is claimed is:

1. A method for maintenance of a liquid discharge head, the method comprising:

a wiping processing step of performing wiping processing on a liquid discharge surface by eccentrically rotating a wiping surface of a wiping member, which includes raised irregularities on the wiping surface thereof, in a plane parallel to the liquid discharge surface of a liquid discharge head and moving the wiping member in a first direction in a state in which the wiping surface is in contact with the liquid discharge surface;

a post-wiping processing purge processing step of performing post-wiping processing purge processing for discharging liquid, which is present in the liquid discharge head, from a plurality of nozzles provided on the liquid discharge surface by adjusting internal pressure of the liquid discharge head to a pressure, which is equal to or higher than the atmospheric pressure, after the wiping processing step; and a purge period setting step of setting a purge period of the post-wiping processing purge processing step to a period three or more times as long as a standard purge period and five or less times as long as the standard purge period, the standard purge period being a processing period of a standard purge processing step, wherein an eccentric parameter as a value obtained by dividing an eccentric distance, which is represented by a distance between a center of noneccentric rotation and a center of eccentric rotation of the wiping surface, by an interval between the nozzles in a second direction orthogonal to the first direction, is set to 10 or more, the wiping member is eccentrically rotated, and a pressing force, which allows the irregularities of the wiping surface to be thrust into the nozzles, is applied to the wiping member to make the wiping surface come into contact with the liquid discharge surface, so that the wiping processing is performed on the liquid discharge surface in the wiping processing step.

2. The method for maintenance of a liquid discharge head according to claim 1, further comprising:

a wiping-internal-pressure setting step of setting a set value of the internal pressure of the liquid discharge head of the wiping processing step to a value equal to or larger than a set value of the internal pressure of the liquid discharge head that is set at the time of liquid discharge performed on the basis of input discharge data.

3. The method for maintenance of a liquid discharge head according to claim 1, wherein in the purge period setting step, a processing period of purge processing in a case in which the purge processing is performed alone or a processing period of purge processing at the time of initialization processing is set to the standard purge period.

4. The method for maintenance of a liquid discharge head according to claim 1, wherein in the wiping processing step, the eccentric parameter is set to 20 or more and the wiping member is eccentrically rotated.

5. The method for maintenance of a liquid discharge head according to claim 1, wherein in the wiping processing step, the eccentric parameter is set to 33 or more and the wiping member is eccentrically rotated.

6. The method for maintenance of a liquid discharge head according to claim 1, wherein in the wiping processing step, the eccentric parameter is set to be equal to or smaller than a value where the eccentric distance is obtained as a value smaller than a half of the maximum length of the wiping surface, and the wiping member is eccentrically rotated.

7. The method for maintenance of a liquid discharge head according to claim 1, wherein in the wiping processing step, the center of eccentric rotation of the wiping surface is moved on a straight line along the first direction on the liquid discharge surface.

8. The method for maintenance of a liquid discharge head according to claim 1, wherein a wiping surface, which has the maximum length corresponding to the entire length of the liquid discharge surface in the second direction, is used in the wiping processing step, and the center of eccentric rotation of the wiping surface is moved along a straight line that bisects the entire length of the liquid discharge surface in the second direction and is parallel to the first direction of the liquid discharge surface.

9. The method for maintenance of a liquid discharge head according to claim 1, wherein the wiping member is made to reciprocate in the first direction in the wiping processing step.

10. The method for maintenance of a liquid discharge head according to claim 1, wherein a liquid discharge head having a structure in which a longitudinal direction is the first direction, a lateral direction is the second direction, and the plurality of nozzles are arranged two-dimensionally on the liquid discharge surface is wiped in the wiping processing step.

11. A liquid discharge apparatus comprising:

a liquid discharge head;

a wiping processing unit that performs wiping processing on a liquid discharge surface of the liquid discharge head;

a wiping control unit that controls an operation of the wiping processing unit;

a purge processing unit that performs post-wiping processing purge processing for discharging liquid, which is present in the liquid discharge head, from a plurality of nozzles provided on the liquid discharge surface after the wiping processing performed by the wiping processing unit;

a purge control unit that adjusts internal pressure of the liquid discharge head to a pressure equal to or higher than the atmospheric pressure;

a purge period setting step of setting a purge period of the post-wiping processing purge processing step to a period three or more times as long as a standard purge period and five or less times as long as the standard purge period, the standard purge period being a processing period of a standard purge processing step, wherein the wiping processing unit includes a wiping member that includes raised irregularities on a wiping surface thereof to be in contact with the liquid discharge surface, and has a structure for setting an eccentric parameter as a value obtained by dividing an eccentric distance, which is represented by a distance between a center of noneccentric rotation and a center of eccentric rotation of the wiping surface, by an interval between the nozzles in a second direction, which is orthogonal to a first direction, to 10 or more and eccentrically rotating the wiping member, and the wiping control unit makes the wiping surface come into contact with the liquid discharge surface by applying a pressing force, which allows the irregularities of the wiping surface to be thrust into the nozzles, to the wiping member, eccentrically rotates the wiping surface in a plane parallel to the liquid discharge surface of the liquid discharge head, and moves the wiping member in the first direction in a state in which the wiping surface is in contact with the liquid discharge surface.

* * * * *